US005544965A

United States Patent [19]

Kamoda et al.

[11] Patent Number: 5,544,965

[45] Date of Patent: Aug. 13, 1996

[54] PRINTER

[75] Inventors: Hitoshi Kamoda; Tomohiro Maekawa; Yasuji Yui, all of Kanagawa; Shin Iima, Tokyo; Takashi Bunya, Kanagawa, all of Japan

[73] Assignee: Sony Corporation, Japan

[21] Appl. No.: 245,700

[22] Filed: May 18, 1994

[30] Foreign Application Priority Data

Jun. 1, 1993 [JP] Japan ..... 5-130751

[51] Int. Cl.[6] ..... B41J 11/42

[52] U.S. Cl. ..... 400/582; 400/74; 400/708

[58] Field of Search ..... 400/208, 582, 400/74, 708; 355/311; 395/111

[56] References Cited

U.S. PATENT DOCUMENTS

| | | | |
|---|---|---|---|
| 4,396,307 | 8/1983 | Shah et al. | 400/625 |
| 4,569,608 | 7/1984 | Watanabe | 400/208 |
| 4,727,437 | 2/1988 | Mizoguchi | 400/708 |
| 5,071,273 | 12/1991 | Kato | 400/630 |
| 5,169,249 | 12/1992 | Kitabata | 400/582 |
| 5,321,486 | 6/1994 | Nanbu et al. | 355/311 |

FOREIGN PATENT DOCUMENTS

| | | | |
|---|---|---|---|
| 308677 | 12/1989 | Japan | 400/74 |
| 39967 | 2/1990 | Japan | 400/74 |
| 2231172 | 9/1990 | Japan | 400/582 |

*Primary Examiner*—Edgar S. Burr
*Assistant Examiner*—John S. Hilton
*Attorney, Agent, or Firm*—Ronald P. Kananen

[57] ABSTRACT

A color video printer can identify the length of a print sheet inserted therein for ejecting any print sheets other than a standard print sheet. The printer has a sheet feed sensor and another sensor disposed downstream of the sheet feed sensor with respect to the direction in which a print sheet is fed in the printer. After the leading end of an inserted print sheet is detected by the sheet feed sensor, the print sheet is fed until the leading end thereof is detected by the other downstream sensor. At this time, the length of the print sheet which is fed is equal to the distance, typically of 128 mm, between the sensors. The true length of the print sheet is calculated by adding, to 128 mm, the length of the print sheet which is further fed until the trailing end of the print sheet is detected by the sheet feed sensor.

8 Claims, 30 Drawing Sheets

H0

H1, H2, H3, H3', H4

HO. PO

H2.PO

H2, P1

H3.P2

H4,P2

H2, P2

PRINTER

BACKGROUND OF THE INVENTION

1. Field of the Invention

The present invention relates to a printer for printing a recorded image such as a video image or the like as a hard copy in the form of a color photograph, and more particularly to a color video printer of the sublimational thermal-transfer type.

2 . Description of the Related Art

Conventional color video printers of the type described above are designed such that they do not eject a print sheet other than predetermined-size print sheets when such a print sheet is inserted therein.

In the color video printers, a printing process to be employed is determined by identifying only one of a print sheet and an ink ribbon. More specifically, (a) a mark is applied to the reverse side of a print sheet, and a printing process such as a mirror-reversed printing process is effected by identifying the mark, or (b) a detectable mark is applied to a ribbon cassette, and a printing process is determined by identifying the detectable mark.

When a print sheet other than predetermined-size print sheets is inserted into a conventional video printer, the conventional video printer does not eject the inserted print sheet.

However, when a print sheet other than predetermined-size print sheets is inserted into a printer, e.g., when a print sheet having a length other than a standard length is inserted into a printer which can use other print sheets such as postal cards than dedicated print sheets that are coated for use in sublimational printers, it is necessary to eject such an inserted print sheet. If such an inserted print sheet is not ejected, then it may cause a sheet feed error, a sheet discharge error, or a sheet jam in the printer.

When a desired image is to be printed in a panoramic mode, for example, on a print sheet longer than commercially available print sheets, e.g., dedicated print sheets that are 140.8 mm long and postal cards that are 148 mm long, it is necessary to change a printing condition and a printing process depending on the length of the print sheet used.

If a printing process is to be determined by identifying only one of a print sheet and an ink ribbon used, then as the number of available types of ink ribbons and print sheets increases, it is unable to determine a printing process that matches a print sheet and an ink ribbon used simply by identifying them, and it is impossible to eject a combination of a print sheet and an ink ribbon which are possibly responsible for causing the trouble of a mismatch.

It is therefore necessary to identify both an ink ribbon and a print sheet, and effect subsequent processing in a manner to match their combination.

A printer which can use other print sheets such as postal cards than dedicated print sheets is required to identify print sheets by their length because the printer has to handle print sheets with no mark on their reverse side, such as dedicated print sheets that are commercially available.

OBJECTS AND SUMMARY OF THE INVENTION

It is therefore an object of the present invention to provide a printer which can identify the length of a print sheet and eject any print sheets other than standard print sheets.

Another object of the present invention is to provide a printer which can identify an ink ribbon, determine the length of a print sheet, and change a printing process depending on the matching between the ink ribbon and the length of the print sheet.

According to the present invention, there is provided a printer comprising a roller for feeding a print sheet into a printer mechanism, a sensor for detecting whether a print sheet is fed into the printer mechanism, a feed distance detector for detecting a distance over which a print sheet is fed in the printer mechanism, a sheet length detector for detecting the length of a print sheet when the print sheet is fed, with a single sensor for detecting whether there is a print sheet or not, and a controller for ejecting a print sheet other than a standard print sheet so as not to be printed, based on the distance detected by the feed distance sensor and the length detected by the sheet length detector. The printer may also includes a second sensor disposed downstream of the first-mentioned sensor with respect to a direction in which a print sheet is fed in the printer mechanism, the first-mentioned sensor and the second sensor being spaced from each other by a distance shorter than the length of a predetermined print sheet, the controller comprising means for detecting the length of a print sheet based on signals detected by the first-mentioned sensor and the second sensor.

After the leading end of an inserted print sheet is detected by the first-mentioned sensor, the print sheet is fed until the leading end thereof is detected by the second sensor. At this time, the length of the print sheet which is fed is equal to the distance, typically of 128 mm, between the sensors. The true length of the print sheet is calculated by adding, to 128 mm, the length of the print sheet which is further fed until the trailing end of the print sheet is detected by the first-mentioned sensor.

According to the present invention, there is also provided a printer for printing a print sheet with an ink ribbon, comprising a ribbon identification sensor for identifying the type of an ink ribbon, a sheet length identification sensor for identifying the length of a print sheet, and a controller for determining a printing process and a printing condition based on the matching between the type of an ink ribbon identified by the ribbon identification sensor and the length of a print sheet identified by the sheet length identification sensor.

When an ink ribbon is installed in the printer, the type of the ink ribbon is identified by the ribbon identification sensor. When a print sheet subsequently starts being fed, the length of the print sheet is identified by the sheet length identification sensor. If the type of the ink ribbon and the length of the print sheet are matched, then the print sheet is printed under a printing condition depending on the combination of the ink ribbon and the print sheet. If there is a mismatch between the type of the ink ribbon and the length of the print sheet, then the print sheet is ejected out of the printer. If the print sheet cannot be ejected, then any printing process of the printer is canceled.

The above and other objects, features, and advantages of the present invention will become apparent from the following description of an illustrative embodiment thereof to be read in conjunction with the accompanying drawings, in which like reference numerals represent the same or similar objects.

DETAILED DESCRIPTION OF THE PREFERRED EMBODIMENT

The present invention as embodied in a color video printer of the sublimational thermal transfer type, for example, will be described below with reference to the accompanying drawings.

An overall construction of a video printer according to the embodiment will first be described below.

Figure 1:
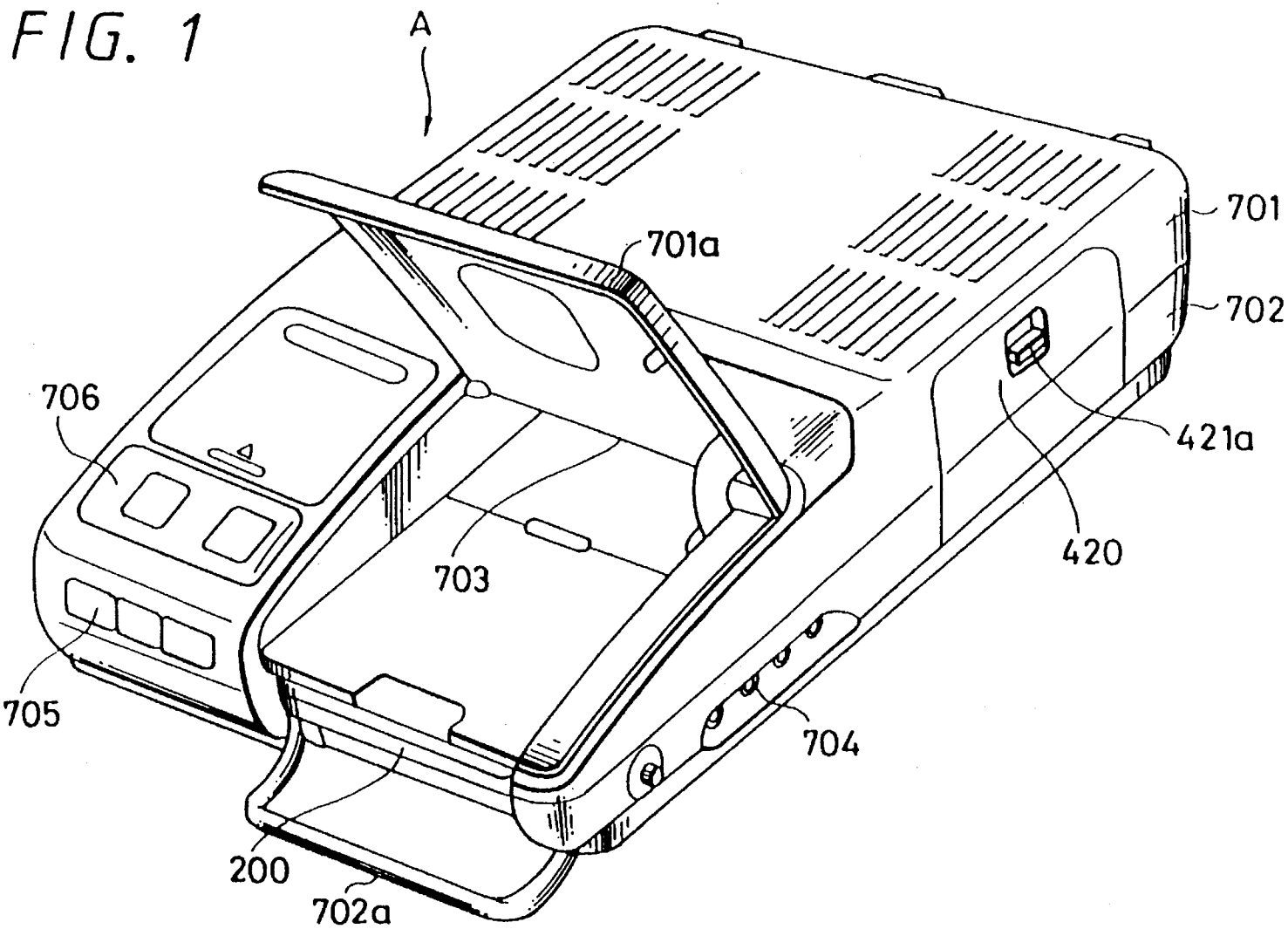
FIG. 1 is a perspective view of a printer according to the present invention.

FIG. 1 shows in perspective a video printer (hereinafter simply referred to as a "printer"), generally denoted at A. The printer A has a housing composed of upper and lower cases 701, 702 made of plastic. The printer A has an ink ribbon door 420 openably and closably disposed on a rear portion thereof for storing an ink ribbon cassette (hereinafter referred to as "ribbon cassette") in the printer A.

The printer A also has on a front portion a sheet feed tray 200, a print sheet discharge slot 703, video signal input terminals 704, a power supply switch 705, and various switches 706 for determining an image to be printed and indicating the number of prints to be produced.

The sheet feed tray 200 can be taken into and out of the printer A by opening a sheet door 702*a* of the lower case 702 and a sheet discharge cover 701*a* of the upper case 701.

FIGS. 2, 3, 4, and 5 are vertical cross-sectional views taken along different vertical planes across the printer A. The printer A includes a channel-shaped chassis 401 having an upper opening with a top plate 404 disposed therein and side surfaces with a bracket 100 and a rear bracket 301 mounted thereon. A ribbon cassette 1 is housed in a side opening 401*a* in the chassis 401. The sheet feed tray 200 is removably mounted in a front opening 401*b* in the chassis 401.

The sheet feed tray 200 has rectangular holes defined in a bottom thereof for insertion therein of a finger 201*a* of a sheet feed plate 201 and respective fingers 203*a* of a pair of laterally spaced pressers 203. The sheet feed plate 201 and the pressers 203 can be turned about the respective fingers 201*a*, 203*a* by a sheet feed arm 204 (see FIG. 4) that is angularly moved by a cam (described later on), for pressing an end of a print sheet 202 in the sheet feed tray 200 against a sheet feed roller 213. The sheet feed tray 200 is guided by rails (not shown) and installed in position in the printer A.

During sheet feeding operation, a lock finger 209 is turned by the cam, and engages in a hole 200*a* defined in the sheet feed tray 200 to prevent the sheet feed tray 200 from being pulled out.

The printer A generally comprises an ink ribbon mechanism actuatable by a DC motor as a drive source for winding and rewinding an ink ribbon in the ribbon cassette 1 to bring the head of the ink ribbon into an operative position or during printing operation, a print sheet feed/discharge mechanism actuatable by a stepping motor as a drive source for supplying a print sheet from the tray 200 into a print position and discharging a printed print sheet from the print sheet discharge slot 703, and a head mechanism actuatable by a DC motor as a drive source for causing a linear thermal head to print an image on a print sheet.

The ink ribbon mechanism, the print sheet feed/discharge mechanism, and the head mechanism will hereinafter be described in the order named.

Figure 6:
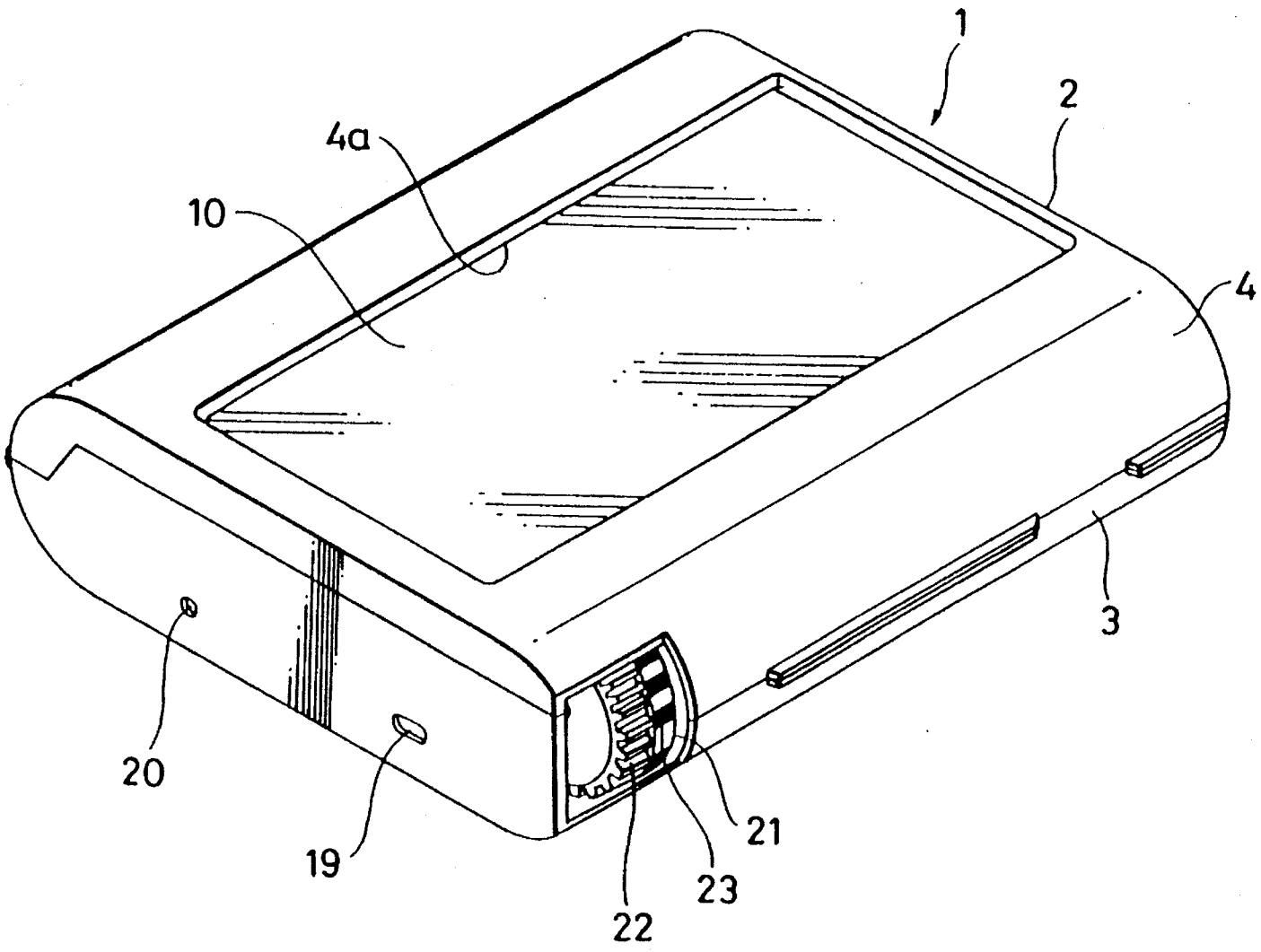
FIG. 6 is a perspective view of a ribbon cassette.
Figure 7:
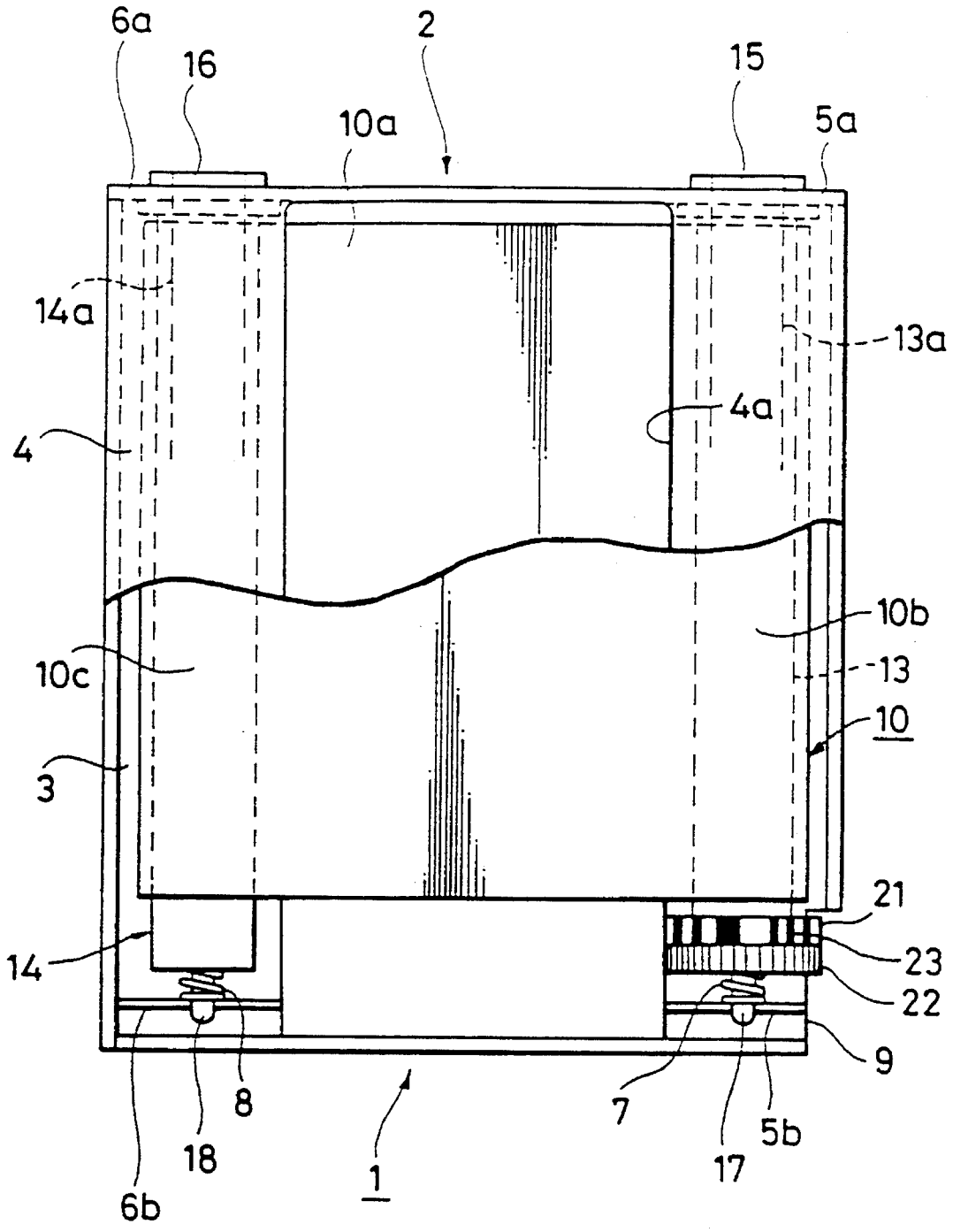
FIG. 7 is a plan view, partly broken away, of the ribbon cassette.
Figure 8:
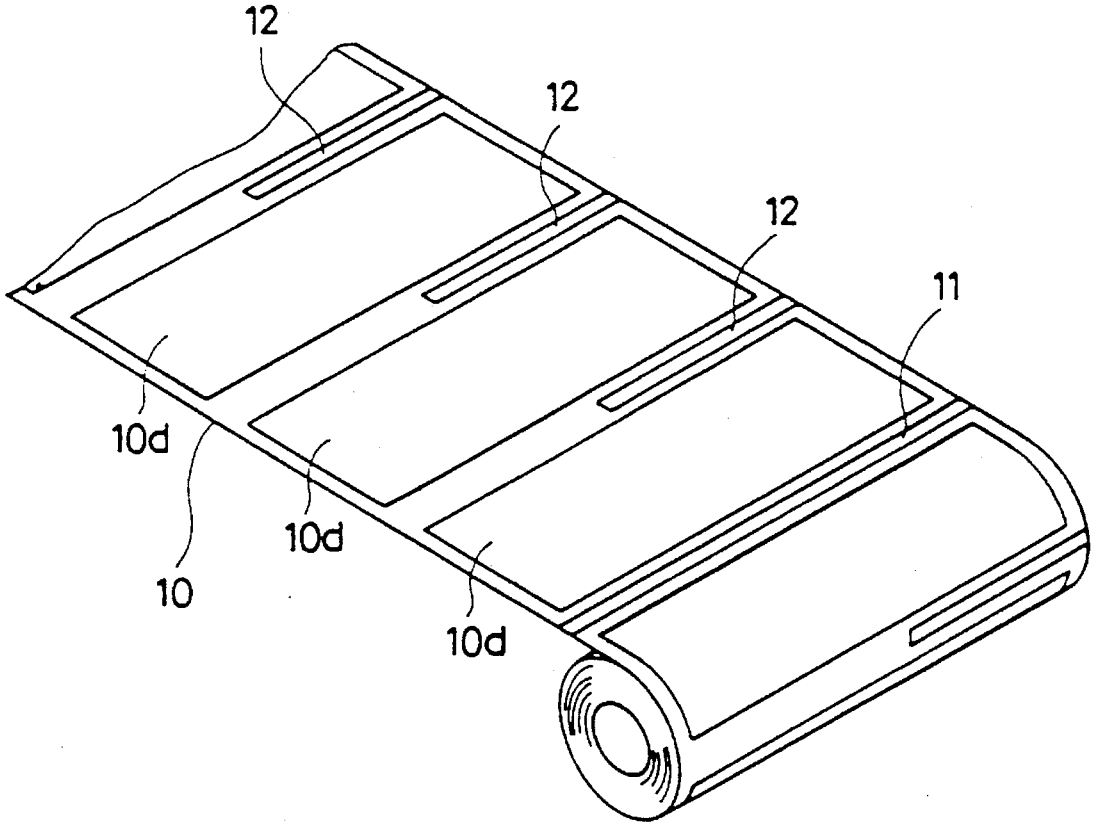
FIG. 8 is a perspective view of an ink ribbon.

FIGS. 6 through 8 show the ribbon cassette 1 in detail. The ribbon cassette 1 has a cassette casing 2 composed of lower and upper cases 3, 4 made of synthetic resin. The upper case 4 has a central rectangular opening 4*a* defined therein through which a usable ink ribbon portion 10*a* of an ink ribbon 10 is exposed. The lower and upper cases 3, 4 jointly provide a pair of bearings 5*a*, 5*b* by which there are rotatably supported an end 15 and a shaft end 17 of a supply spool 13 with an unused ink ribbon portion 10*b* wound thereon, and another pair of bearings 6*a*, 6*b* by which there are rotatably supported an end 16 and a shaft end 18 of a takeup spool 14 for winding a used ink ribbon portion 10*c* thereon.

The supply spool 13 and the takeup spool 14 are normally axially urged toward the bearings 5*a*, 6*a*, respectively, by respective compression coil springs 7, 8. A code ring 21 is rotatably mounted coaxially on the supply spool 13. The code ring 21 has an information code 23 on its outer circumferential surface which represents information with respect to the type, sensitivity, and count of the ink ribbon 10. Even when the supply spool 13 is held at rest, the code ring 21 can be rotated by a gear 22 which can be driven from outside of the ribbon cassette 1.

When not subjected to forces from outside of the ribbon cassette 1, the code ring 21 can rotate with the supply spool 13 due to frictional forces developed between the supply spool 13 and the code ring 21. The ink ribbon 10 is printed with a header mark 11 that extends fully transversely thereacross, the header mark 11 indicating the position where the ink ribbon 10 is to start writing information upon printing. If the ink ribbon 10 is a multicolor ink ribbon, then it is printed with patch marks 12 that extend transversely a half of the width of the ink ribbon 10, the patch marks 12 indicating the positions where ink ribbon portions 10*d* of respective spective colors are to start writing information upon printing. The cassette casing 2 has holes 19, 20 in which cassette pins 402, 403 (see FIG. 2) engage to position the cassette casing 2 when the ribbon cassette 1 is inserted in the printer.

Figure 9:
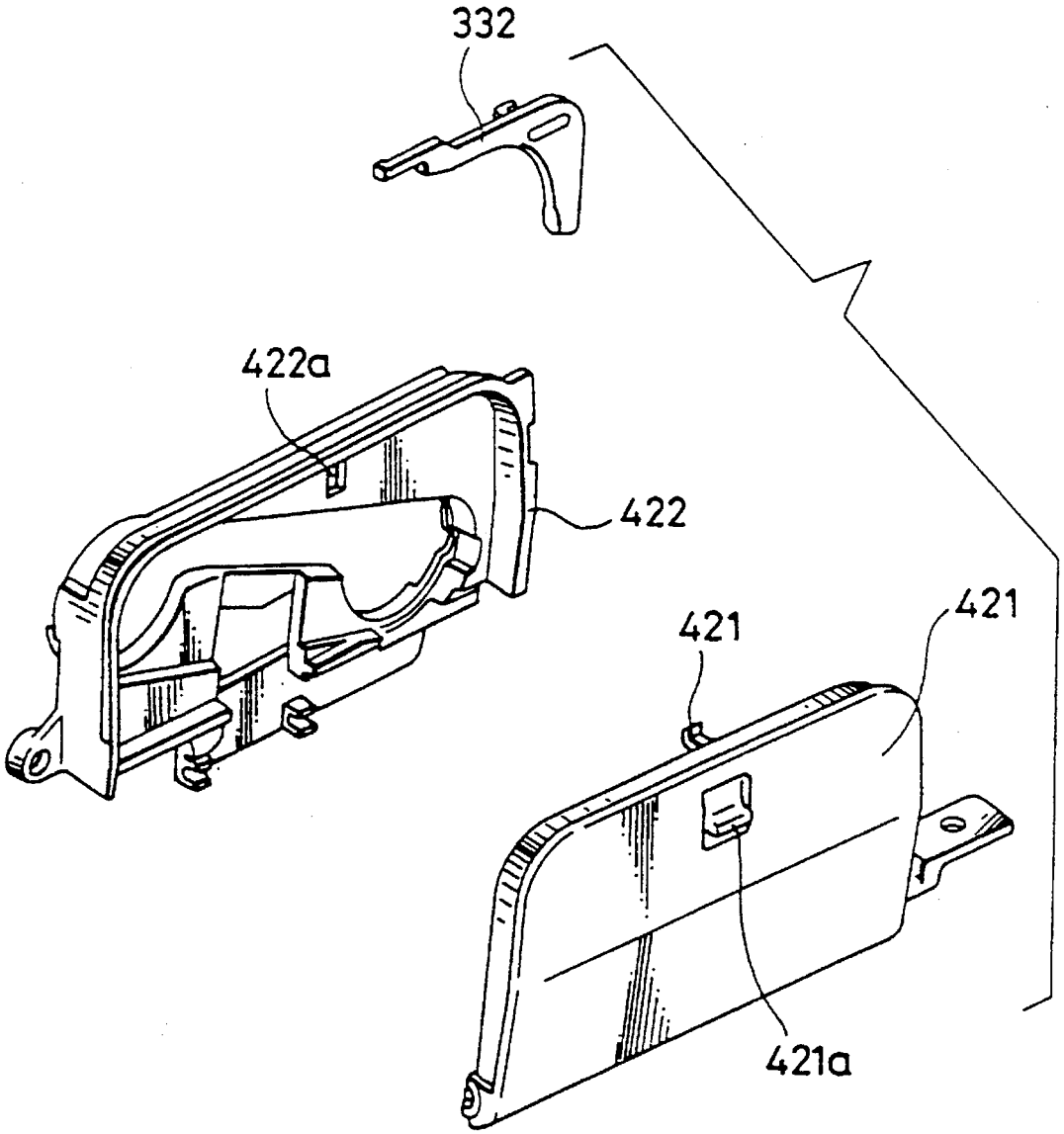
FIG. 9 is a perspective view of an ink ribbon door and a ribbon door holder.
Figure 10:
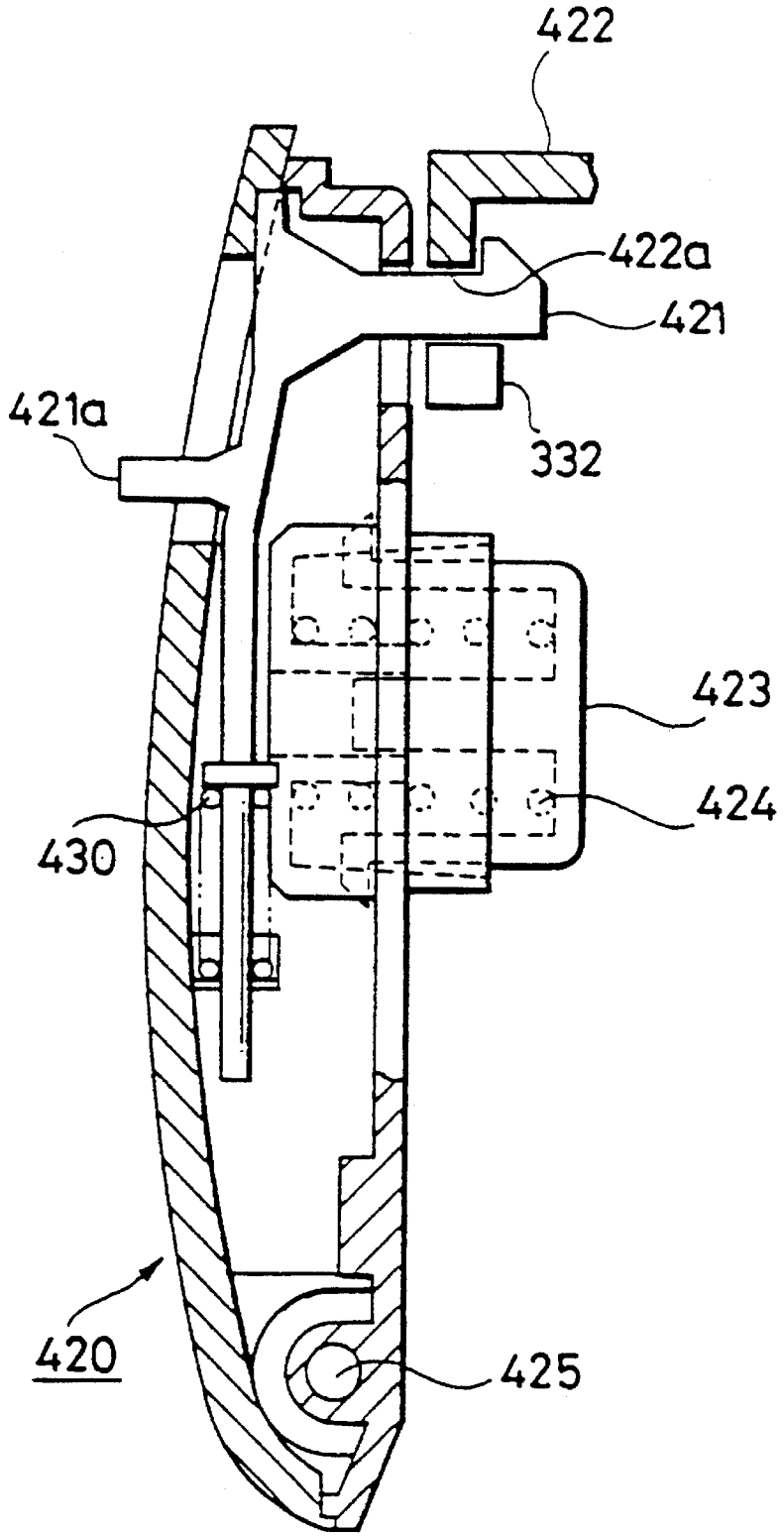
FIG. 10 is a cross-sectional view of the ink ribbon door.

Ribbon door 420:

A section where the ribbon cassette 1 can be inserted into and removed from the printer will be described below with reference to FIGS. 9 and 10. An inlet guide 426 (see FIG. 4) is mounted in the opening 401*a*, and the ink ribbon door 420 is angularly movably supported on the inlet guide 426 by a shaft 425. The ink ribbon door 420 has a lock finger 421 which can engage in a hole 422*a* defined in a ribbon door holder 422 to keep the ink ribbon door 420 closed. The lock finger 421 is normally biased by a spring 430 so as not to be unlocked from the hole 422*a*. The lock finger 421 has a knob 421*a* projecting outwardly of the ink ribbon door 410 and which can be pressed downwardly to disengage the lock finger 421 from the hole 422*a* for thereby allowing the ink ribbon door 420 to be opened.

Figure 4:
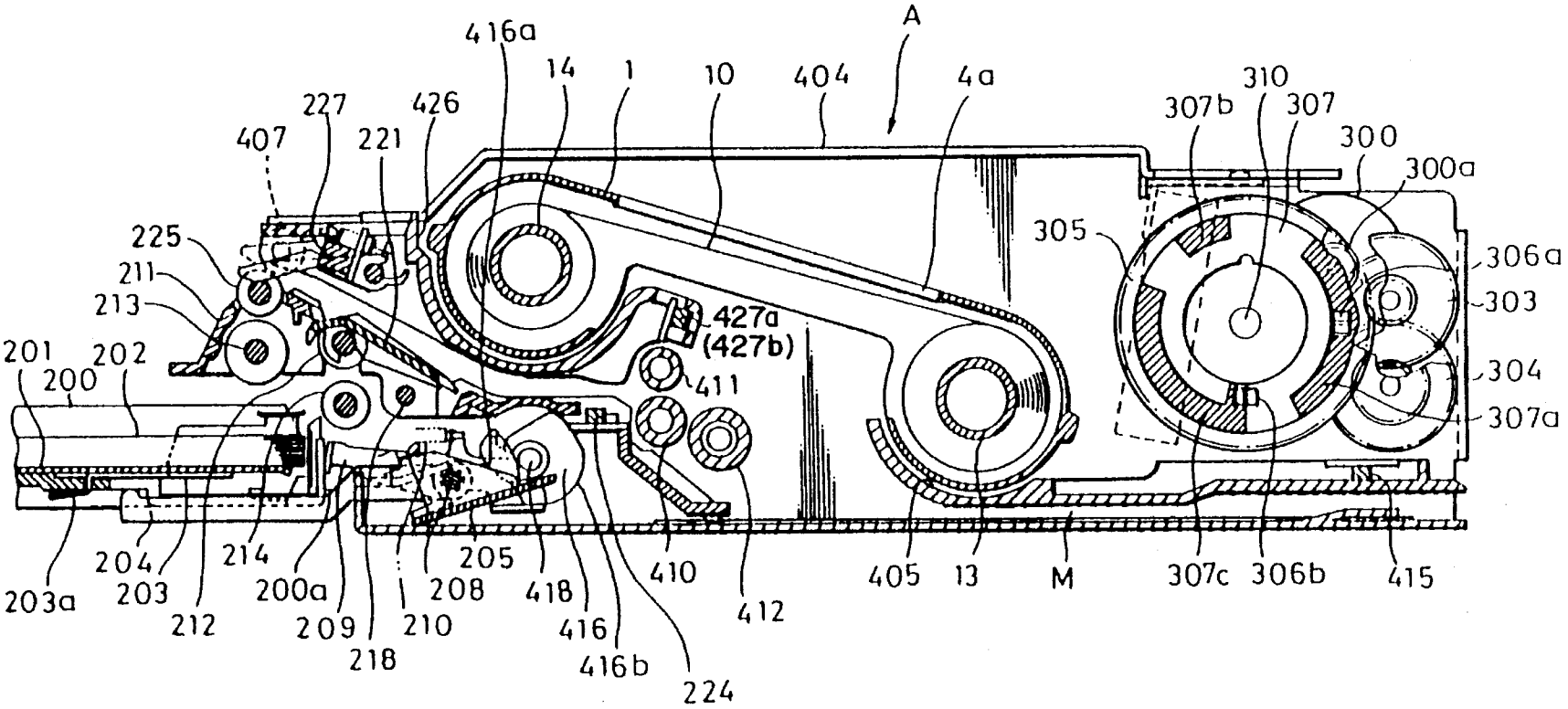
FIG. 4 is a cross-sectional view of the printer, taken along a plane across a gear.

The ribbon cassette 1 can be guided by the inlet guide 426 until it is stored in a cassette storage chamber 405 (see FIG. 4). When the ink ribbon door 420 is closed after the ribbon cassette 1 has been stored in the cassette storage chamber 405, the ink ribbon door 420 is locked by the lock finger 421, and the stored ribbon cassette 1 is urged inwardly into the printer by a ribbon presser 423 that is biased by a spring 424 projecting behind the ink ribbon door 420.

Lock lever for ribbon door 420:

In order to prevent the ribbon cassette 1 from being removed during printing operation, a lock lever 332 attached to the ink ribbon door 420 is positioned underneath the lock finger 421 by a cam (described later on) to limit downward movement of the lock finger 421. During printing operation, therefore, the operator cannot depress the knob 421*a* of the lock finger 421, and hence unlock the lock finger 421. Consequently, the ink ribbon door 420 cannot be opened, making it impossible to remove the ribbon cassette 1.

Operation of the ink ribbon mechanism with the DC motor as the drive source thereof will be described below.

Parts that are driven by rotation of a motor 101 (see FIG. 5) will first be described below. The motor 101 is rotatable in normal and reverse directions, and a pendulum gear 107 operates to switch between different rotation transmitting paths when the motor 101 rotates in the normal or reverse direction. Specifically, when the motor 101 rotates in one direction, the rotation is transmitted through a takeup reel base 111 to the takeup spool 14 of the ribbon cassette 1, and when the motor 101 rotates in the opposite direction, the rotation is transmitted to a cam of a print sheet feed mechanism.

Transmission of rotation to takeup spool 14:

The rotation of the motor 101 is transmitted through a worm base 103 press-fitted over the shaft of the moor 101 to a worm 104 and then to double gears 105, 106 by which the speed of rotation is reduced. Frictional forces are developed as by a spring (not shown) between the pendulum gear 107 and a pendulum gear arm 108. When the double gear 106 rotates clockwise in FIG. 5, the pendulum gear arm 108 also rotates clockwise, bringing the pendulum gear 107 into mesh with a gear 109 which transmits the rotation to a gear 110 (see FIG. 11). The gear 110 is part of the takeup reel base 111 which has a torque limiting function.

Figure 11:
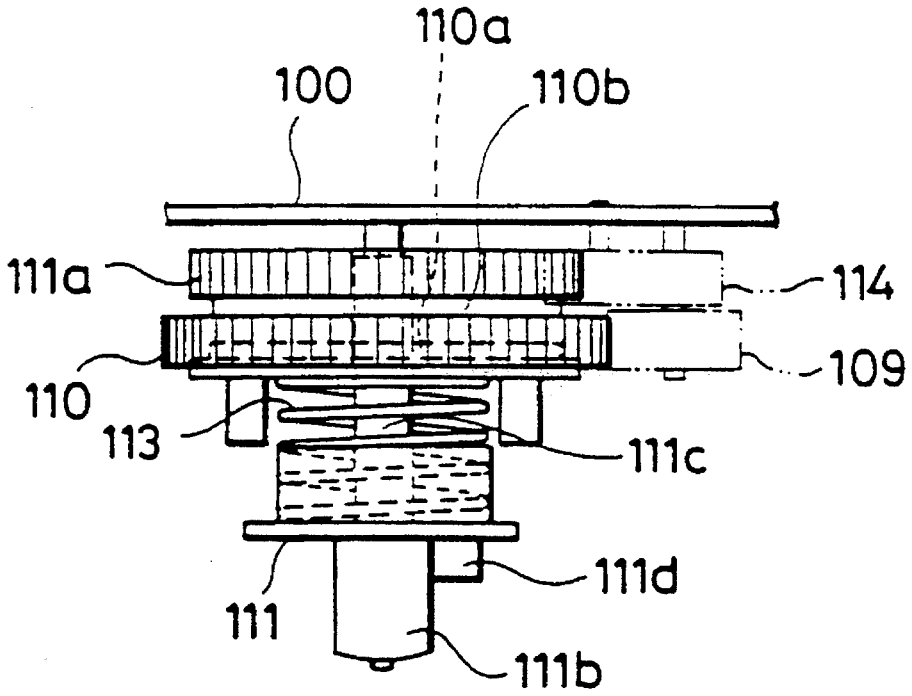
FIG. 11 is a detailed view of the takeup reel base.

The takeup reel base 111 is shown in FIG. 11. Felt pieces 110*a*, 110*b* are applied to respective opposite surfaces of the gear 110, which is rotatable with a pressure plate 112 about a hollow shaft 111*c*. A gear 111*a* and an engaging boss 111*b*, which serves to transfer torques to the takeup spool 14 of the ribbon cassette 1, are press-fitted over the shaft 111*c*, so that the gear 111*a*, the engaging boss 111*b*, and the shaft 111*c* are rotatable in unison with each other. The pressure plate 112 is rotatable in the same direction as the engaging boss 111*b* by engagement between concave and convex portions of the pressure plate 112 and the engaging boss 111*b*.

A compression coil spring 113 is disposed between the engaging boss 111*b* and the pressure plate 112 for normally applying forces tending to press the felt piece 110*a* and the pressure plate 112 against each other and also to press the felt piece 110*b* and the gear 111*a* against each other, developing frictional forces. When the gear 110 is rotated, a torque produced due to the frictional forces is transmitted to the engaging boss 111*b*. When a torque greater than the torque produced due to the frictional forces is generated, since the felt pieces 110*a*, 110*b* slip against the pressure plate 112 and the gear 111*a*, respectively, such a torque cannot be transmitted to the engaging boss 111*b*.

The engaging boss 111*b* is fitted in an engaging sleeve 14*a* of the takeup spool 14. When the takeup spool 14 is angularly positioned to allow a tooth 111*d* of the engaging boss 111*b* to engage the engaging sleeve 14*a*, the rotation can be transmitted to the takeup spool 14.

Figure 12:
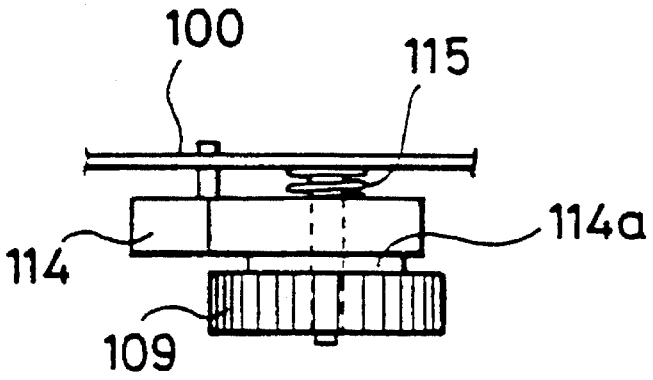
FIG. 12 is a detailed view of a gear.

Reverse prevention finger of the takeup reel base 111:

A finger 114 is mounted on the gear 109 for rotation in the same plane as the gear 111*a*. As shown in FIG. 12, a felt piece 114*a* is applied to the finger 114 and held against the gear 109. Frictional forces are developed between the felt piece 114*a* and the gear 109 by a compression coil spring 115 for rotating the finger 114 in the same direction as the gear 109. When the double gear 106 rotates clockwise, the gear 109 also rotates clockwise through the pendulum gear 107, and so does the finger 114. The finger 114 is prevented from unduly rotating by a hole 100*a* defined in the bracket 100. The function of the finger 114 will be described later on.

Transmission of rotation for movement to a sheet position:

When the double gear 106 rotates counterclockwise, the pendulum gear arm 108 rotates in the same direction as the double gear 105 to bring the pendulum gear 107 into mesh with a gear 116.

Reverse rotation preventing finger:

If the takeup spool 14 is reversed, thus loosening the ink ribbon, due to vibrations of the printer or electrostatic charges in the printer, then the takeup reel base 111 is also reversed and the gear 109 tends to rotate counter-clockwise. Since the finger 114 is also rotated in the same direction as the gear 109, the finger 114 engages the gear 111*a* of the takeup reel base 111, thereby preventing the takeup reel base 111 from being rotated and hence preventing the ink ribbon from being loosened. (As long as the pendulum gear 107 is in mesh with the gear 109, the reverse rotation of the takeup reel base 111 is transmitted to the gears, tending to rotate the worm 104. However, since the worm 104 is a single worm, it is not rotated by the rotation of the double gear 105. Therefore, the takeup reel base 111 is not reversed, and the ink ribbon is not loosened.)

Figure 13A:
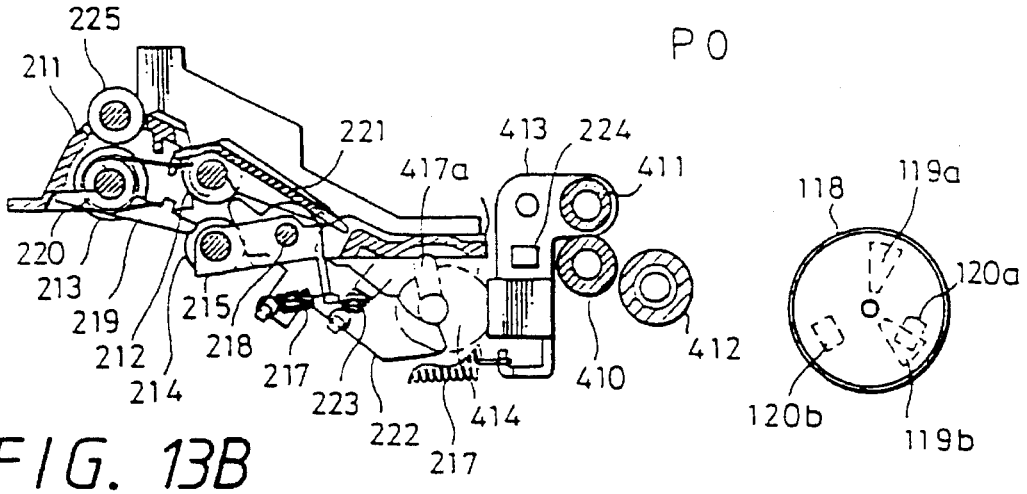
FIGS. 13A, 13B and 13C are diagrams showing the relationship between sensors and sheet positions in respective operation phases.
Figure 13B:
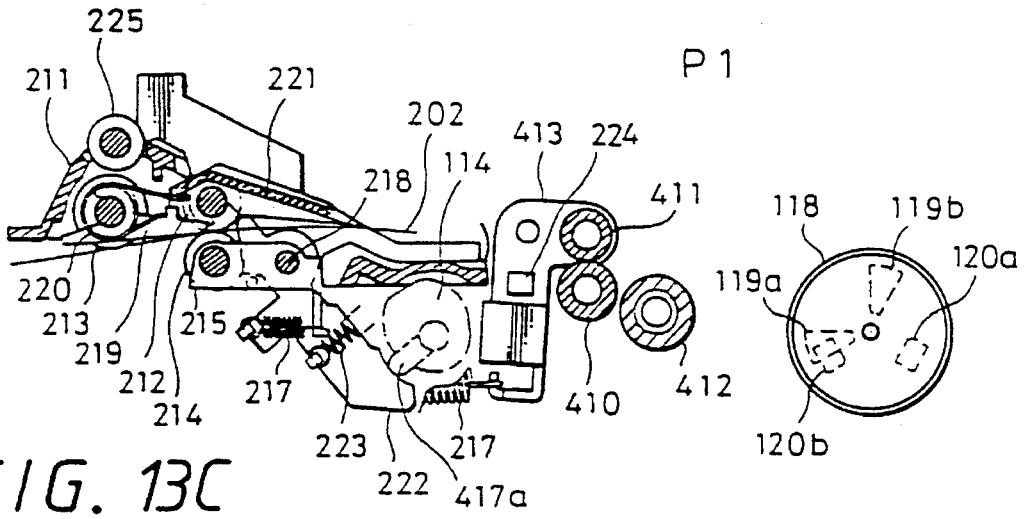
Figure 13C:
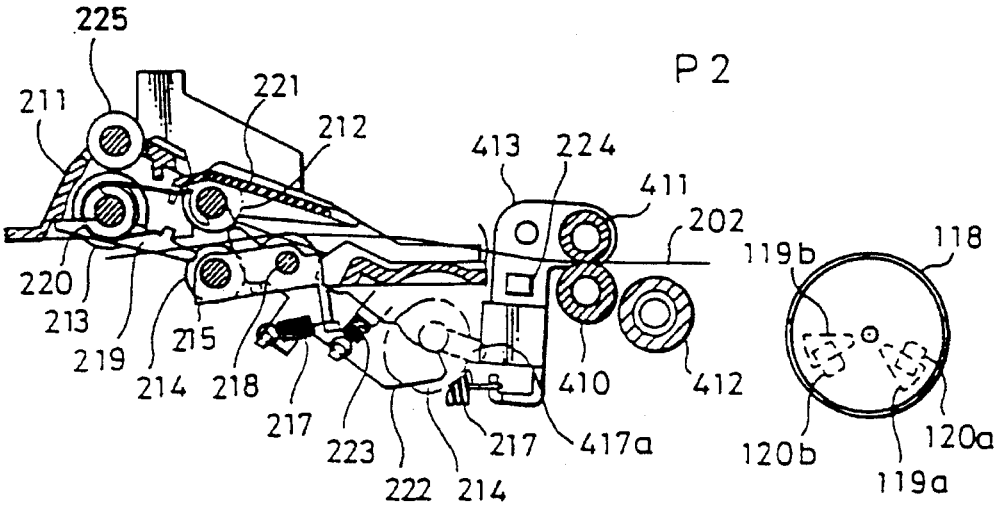

Movement to the sheet position (continued):

The rotation of the gear 116 is transmitted through a gear 117 to a gear 118. The gear 118 has a reflecting seal 119 attached thereto and its angular displacement is monitored by two optical sensors 120*a*, 120*b* that operate in association with the reflecting seal 119. The relationship between the gear 118 and the optical sensors 120*a*, 120*b* is illustrated in FIGS. 13A, 13B, and 13C. The reflecting seal 119 is made of a sheet of aluminum or the like whose surface has a high optical reflectance, and is printed with two black areas 119*a*, 119*b* of a lower optical reflectance. The optical sensors 120*a*, 120*b* detect the black areas 119*a*, 119*b* as dark areas, and the aluminum surface as a bright area.

The gear 118 is rotated only counterclockwise owing to the function of the pendulum gear 107. The rotation of the gear 118 is stopped when the optical sensor 120*a* detects a dark area and the optical sensor 120*b* detects a bright area. This stopped position of the gear 118 is referred to as a sheet position P0 (see FIG. 13A). Then, the gear 118 is rotated 120°, and the rotation of the gear 118 is stopped when the optical sensor 120*a* detects a bright area and the optical sensor 120*b* detects a dark area. This stopped position of the gear 118 is referred to as a sheet position P1 (see FIG. 13B). Then, the gear 118 is further rotated 120°, and the rotation of the gear 118 is stopped when the optical sensor 120*a* detects a dark area and the optical sensor 120*b* detects a dark area. This stopped position of the gear 118 is referred to as a sheet position P2 (see FIG. 13C). Further rotation of the gear 118 through 120° C. allows the optical sensors 120*a*, 120*b* to detect the sheet position P0. Therefore, the gear 118 can be angularly circulated through the sheet positions, i.e., from P0 to P1 to P2 to P0, and can be moved to and stopped in any desired positions.

Figure 2:
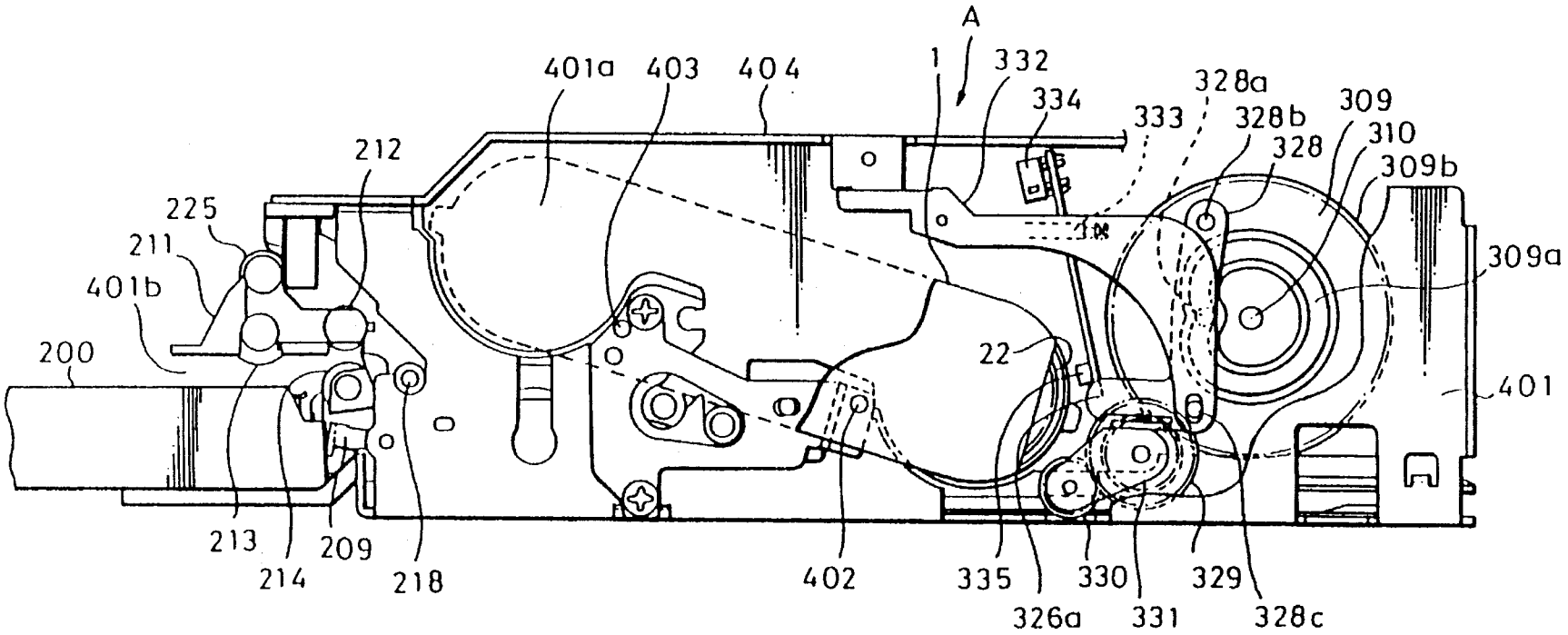
FIG. 2 is a side elevational view, partly broken away, of the printer.
Figure 14:
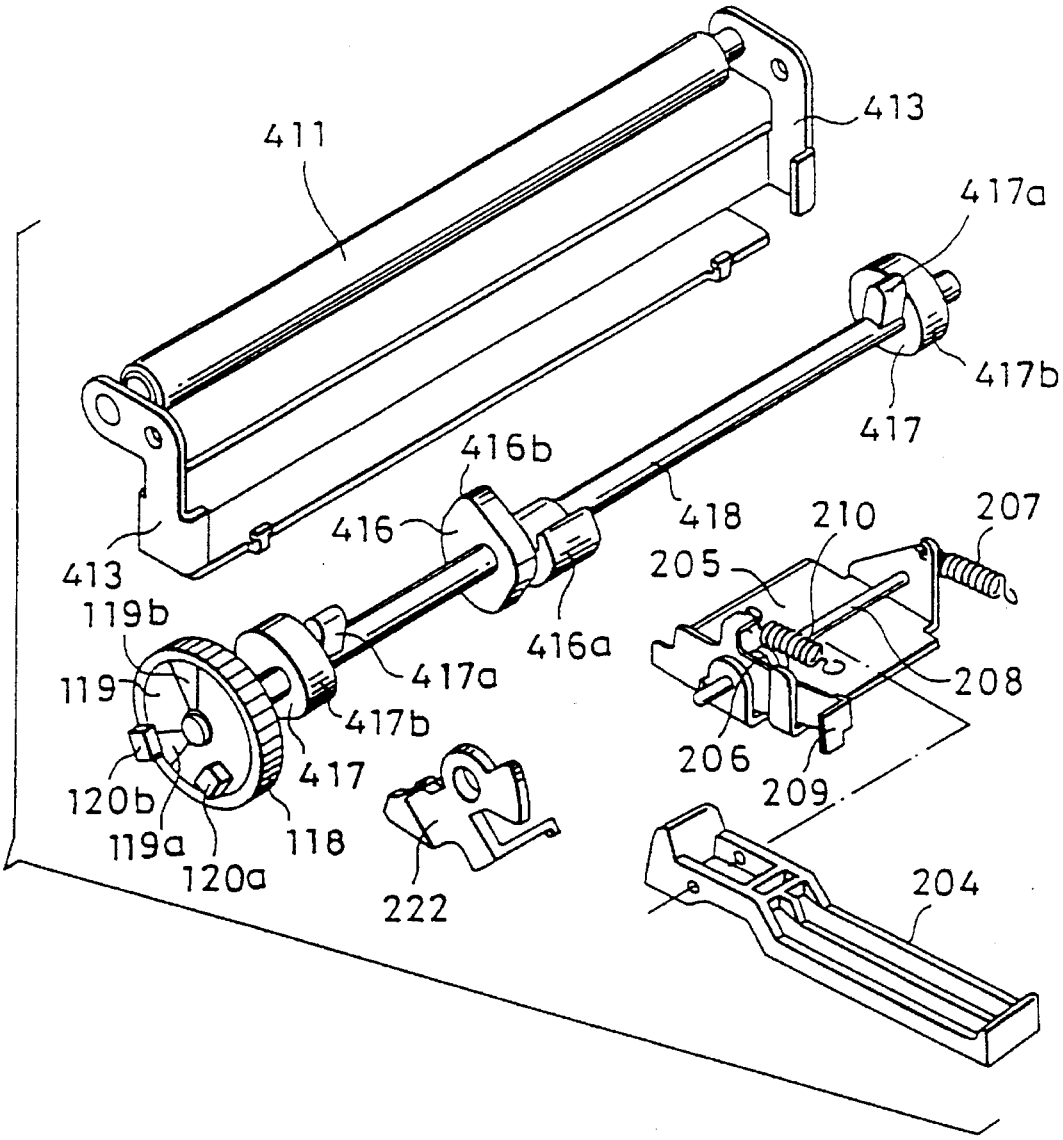
FIG. 14 is an exploded perspective view of a sheet feed cam, release cams, and companion parts.

Movement of cams of sheet positions and companion parts:

As shown in FIG. 14, a sheet feed cam 416 and a pair of release cams 417 are mounted on a shaft 418 which is rotatably supported on the chassis 401 (see FIG. 2). The gear 118 is mounted on an end of the chassis 418 for rotating the sheet feed cam 416 and the release cams 417. The sheet feed cam 416 has a cam surface 416*a* for angularly moving a pressing plate 205 and a cam surface 416*b* for angularly moving the lock finger 209.

Operation of the sheet feed cam 416:

As shown in FIG. 14, the pressing plate 205 is angularly movably mounted on a shaft 208 that is supported on a sheet feed arm 204 and the lock finger 209. The pressing plate 205 is normally urged by a spring 207 to move toward the sheet feed cam 416, and the lock finger 209 is normally urged by a spring 210 to move toward the sheet feed cam 416. The sheet feed arm 204 is pressed against the pressing plate 205 by a torsion coil spring 206 which limits their relative position. When the pressing plate 205 is angularly moved by the cam surface 416*a* of the sheet feed cam 416, the sheet feed arm 204 is also angularly moved therewith for thereby lifting the sheet feed plate 201 (see FIG. 4) to bring a print sheet 202 in the sheet feed tray 200 into contact with the sheet feed roller 213.

Upon continued angular movement of the pressing plate 205, the movement of the sheet feed arm 204 is limited by the sheet feed plate 201 which has been rendered angularly immovable by contact with the sheet feed roller 213. The pressing plate 205 and the sheet feed arm 204 are now angularly moved relatively to each other, causing the torsion coil spring 206 to flex resiliently and store energy. Under the spring force of the torsion coil spring 206, the sheet feed arm 204 applies a pressure to the sheet feed plate 201 for thereby pressing the print sheet 202 against the sheet feed roller 213.

The lock finger 209 is angularly moved by engagement with the cam surface 416*b* of the sheet feed cam 416. When the lock finger 209 is released from the cam surface 416*b*, the lock finger 209 engages in the hole 200*a* defined in the sheet feed tray 200 to prevent the sheet feed tray 200 from being pulled out.

Operation of the release cams 417:

Pinch roller arms 413 which are angularly movably supported the chassis 401 jointly support a pinch roller 411 rotatably thereon. The pinch roller 411 is normally urged in a direction to be pressed against a capstan 410 (see FIG. 3) under the bias of a spring 414. The release cams 417 operate to turn the pinch roller arms 413 in a direction to release the pinch roller 411 out of pressed contact with the capstan 410.

A release lever 222 is angularly movably supported on a shaft 218 (see FIG. 3) and is normally urged to move toward the release cam 417. The release lever 222 is angularly moved by the release cam 417 to cause a spring 217 to turn a turn plate 215 on which a separating roller 214 is rotatably supported, for thereby pressing the separating roller 214 against a sheet feed roller 212 and pushing open a shutter 221 (see FIG. 4) which is angularly movably mounted on the shaft of the sheet feed roller 212 and has been closed by a spring 220.

The spring 220 also biases a presser lever 219 angularly movably mounted on the sheet feed roller 213. The presser lever 219 has its standby position determined by a guide 211. A process of driving the sheet feed roller 212, the sheet feed roller 213, and the separating roller 214 will be described later in detail.

Operation of the stepping motor for actuating the print sheet feed/discharge mechanism will be described below.

A stepping motor 102 (see FIG. 5) is rotatable in normal and reverse directions through an angle which is a multiple of a step angle inherent in the stepping motor 102 under the control of a control circuit. The stepping motor 102 cooperates with the sheet feed cam 416 and the release cams 417 in feeding the print sheet 202, and also with a link 149 (described later) in rotating a supply reel base 146.

Sheet feed system:

Rotation of a pinion 121 that is press-fitted over the shaft of the stepping motor 102 is reduced in speed by a double gear 122 and transmitted to a gear pulley 123. A pendulum gear 124 is coupled to the gear pulley 123 through a pendulum arm 125. Operation of the pendulum gear 124 will be described later on. The rotation of the gear pulley 123 is transmitted to a gear pulley 127 through a belt 126. The gear pulley 127 rotates the capstan 410 for feeding a print sheet. The capstan 410 comprises a roller rotatably supported on the chassis 401 by bearings (not shown) and having a surface processed to provide a large coefficient of friction with a print sheet.

A sheet feed sensor 224 is disposed in the printer on an inlet side of the capstan 410 for detecting whether a print sheet 202 has been fed or not. The sheet feed sensor 224 doubles as a sheet length sensor for detecting the length of a print sheet 202.

Figure 15:
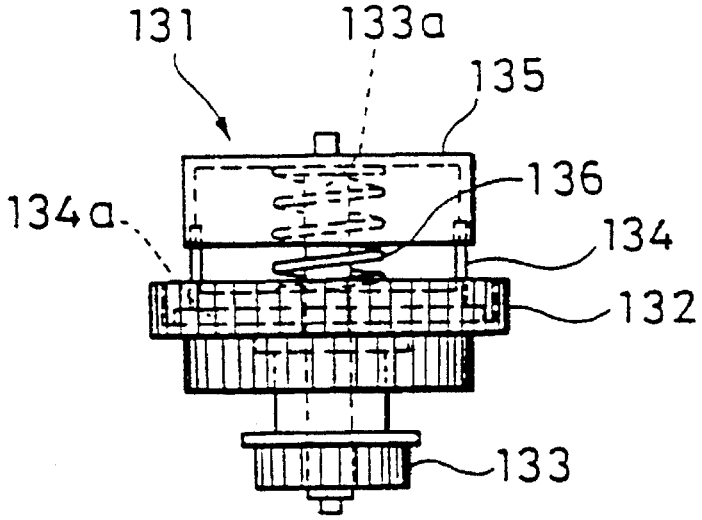
FIG. 15 is a view of a double gear.

The rotation of the gear pulley 127 is transmitted through gears 129, 130 to a double gear 132. The double gear 132 is part of a sheet feed limiter 131 having a torque limiting mechanism as shown in FIG. 15. In FIG. 15, the double gear 132 and a pressure plate 134 to which a felt piece 134*a* is applied are mounted on a hollow shaft 133*a* of a gear 133. A presser plate 135 is fitted over the shaft 133*a* for rotation in unison with the gear 133. The presser plate 135 and the pressure plate 134 are rotatable in the same direction by engagement between concave and convex portions thereof.

A compression coil spring 136 is disposed between the pressure plate 134 and the presser plate 135 for pressing the double gear 132 and the felt piece 134*a* against each other to develop frictional forces therebetween. When the double gear 132 rotates, it transmits a torque produced due to frictional forces to the gear 133. When a torque greater than the torque produced due to frictional forces is generated, since the double gear 132 slips against the felt piece 134*a*, such a torque cannot be transmitted to the gear 133.

Figure 5:
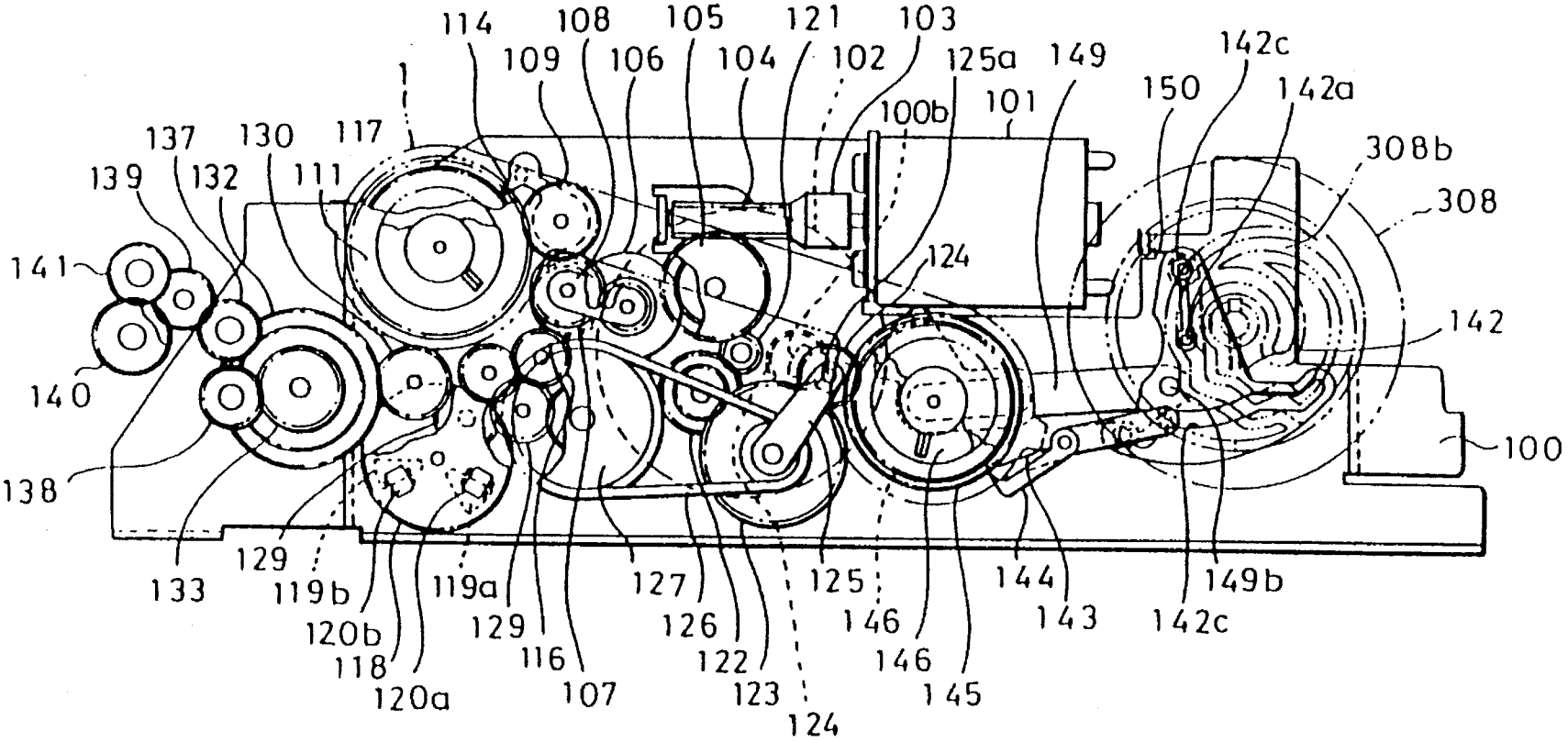
FIG. 5 is a side elevational view of a transmission mechanism system for a takeup reel base, a supply reel base, and a change arm.

As shown in FIG. 5, the rotation of the double gear 132 is transmitted to a gear 137, a gear 139, a double gear 140, and a gear 141. The rotation of the gear 133 is transmitted to a gear 138. The rotation of the gear 137 is transmitted to the sheet feed roller 212. The rotation of the gear 138 is transmitted to the separating gear 214. The rotation of the double gear 140 is transmitted to the sheet feed roller 213. The rotation of the gear 141 is transmitted to a sheet discharge roller 225.

The sheet feed roller 212, the sheet feed roller 213, and the sheet discharge roller 225 are rotatably supported by the guide 211 by bearings. The separating roller 214 is rotatably supported on the turn plate 215 by bearings.

Rewinding of the ink ribbon:

Operation of the pendulum gear 124, which is a central component of the printer, will be described below also with reference to FIGS. 24A through 24D.

Frictional forces are generated between the pendulum gear 124 and the pendulum arm 125 by a spring or the like (not shown). While the pendulum arm 125 rotates in the same direction as the double gear 122, the pendulum arm 125 rotates in a limited angular range defined by a hole 100*b* defined in the bracket 100*a* in which a shaft 125*a* of the pendulum arm 125 is movable. When the double gear 122 rotates clockwise, the pendulum arm 125 rotates counterclockwise until its rotation is limited by an end of the hole 100*b* where-upon the pendulum gear 124 rotates idly. When the double gear 122 rotates counterclockwise, the pendulum arm 125 rotates clockwise to cause the pendulum gear 124 to mesh with a gear 145 of the supply reel base 146.

Figure 16:
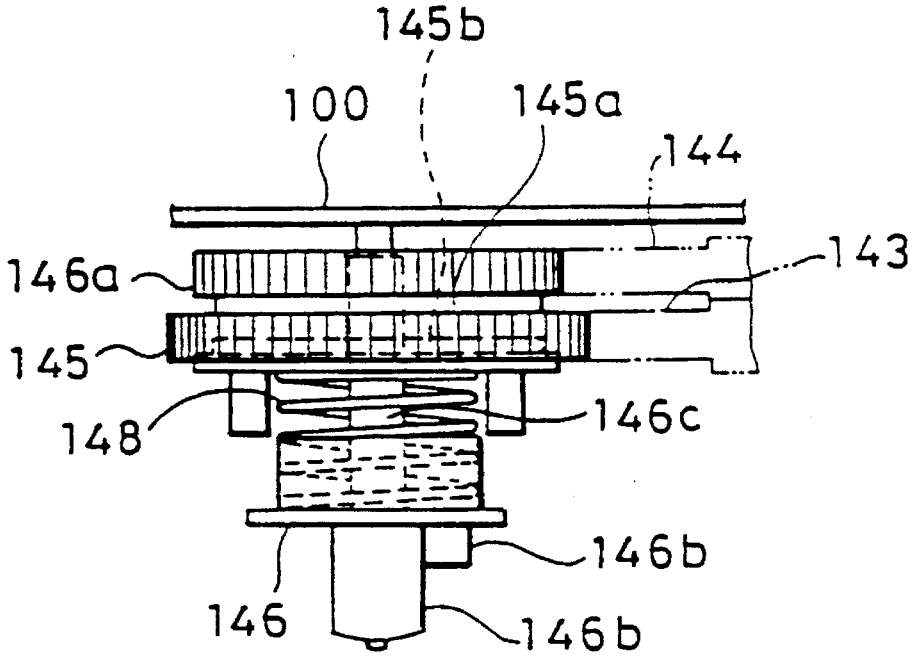
FIG. 16 is a detailed view of the supply reel base.

Supply reel base 146:

FIG. 16 shows the supply reel base 146.

The supply reel base 146 has a torque limiting function and includes a gear 145 with felt pieces 145*a*, 145*b* applied to respective opposite surfaces thereof. The gear 145 is rotatable with a pressure plate 147 about a hollow shaft 146*c*. A gear 146*a* and an engaging boss 146*b*, which serves to transfer torques to the supply spool 13 of the ribbon cassette 1, are press-fitted over the shaft 146*c*, so that the gear 146*a*, the engaging boss 146*b*, and the shaft 146*c* are rotatable in unison with each other.

The pressure plate 147 is rotatable in the same direction as the engaging boss 146*b* by engagement between concave and convex portions of the pressure plate 147 and the engaging boss 146*b*. A compression coil spring 148 is disposed between the engaging boss 146*b* and the pressure plate 117 for normally applying forces tending to press the felt piece 145*a* and the pressure plate 147 against each other and also to press the felt piece 145*b* and the gear 146*a* against each other, developing frictional forces therebetween. When the gear 145 is rotated, a torque produced due to the frictional forces is transmitted to the engaging boss 146*b*. When a torque greater than the torque produced due to the frictional forces is generated, since the felt pieces 145*a*, 145*b* slip against the pressure plate 147 and the gear 146*a*, respectively, such a torque cannot be transmitted to the engaging boss 146*b*. The engaging boss 146*b* is fitted in an engaging sleeve 13*a* of the supply spool 13. When the supply spool 13 is angularly positioned to allow a tooth 146*d* of the engaging boss 146*b* to engage in a recess 13*b* in the engaging sleeve 13*a*, the rotation can be transmitted to the supply spool 13.

Rewinding of the ink ribbon (continued):

Through the above operation, the pendulum gear 124 transmits the rotation to the supply reel base 146 to rotate the supply reel base 146 and hence the supply spool 13 for thereby winding (rewinding) the ink ribbon 10 on the supply spool 13. However, the link 149 moves to enable a tip end 149*a* thereof to reduce the range in which the shaft 125*a* of the pendulum arm 125 is movable, until the pendulum gear 124 is brought out of mesh with the gear 145 whereupon the pendulum gear 124 rotates idly. An arrangement for moving the link 149 will be described later on.

Operation of the DC motor for actuating the head mechanism will be described below.

A motor 300 (see FIG. 4) that is rotatable in normal and reverse directions is mounted on a bracket 301, and rotates a gear 305 at a reduced speed.

Transmission of rotation for movement to a head position:

The rotation of a pinion 300*a* press-fitted over the shaft of the motor 300 is reduced in speed by double gears 302, 303, 304, and transmitted to the gear 305. The gear 305 has a reflecting seal 307 attached thereto and its angular displacement is monitored by two optical sensors 306*a*, 306*b* that operate in association with the reflecting seal 307. The reflecting seal 307 is made of a sheet of aluminum or the like whose surface has a high optical reflectance, and is printed with three black areas 307*a*, 307*b*, 307*c* of a lower optical reflectance. The optical sensors 306*a*, 306*b* detect the black areas 307*a*, 307*b*, 307*c* as dark areas, and the aluminum surface as a bright area.

Figure 19:
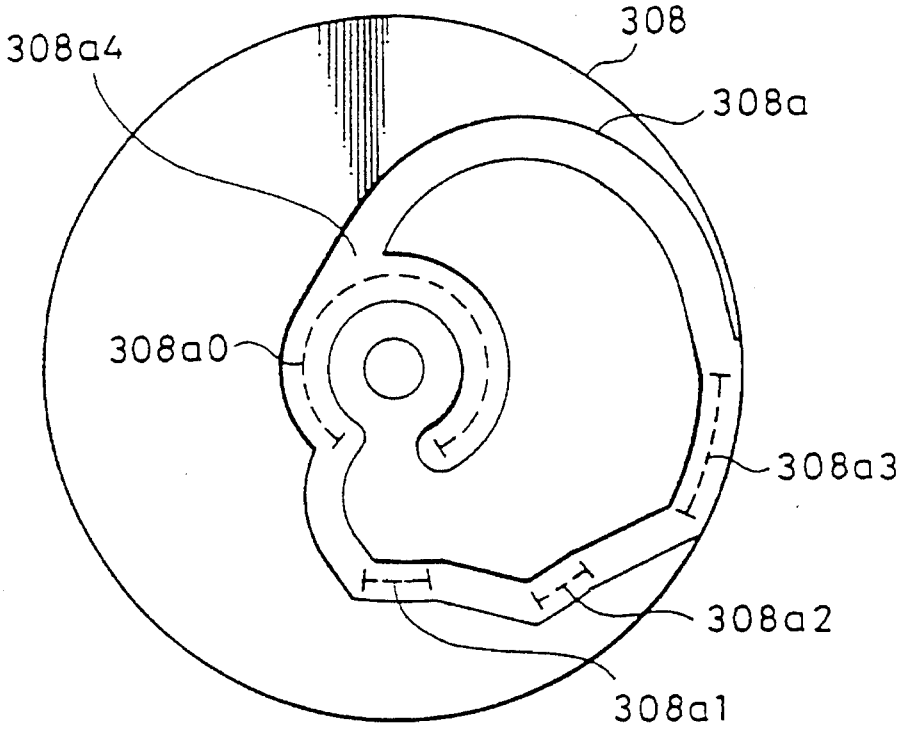
FIG. 19 is a detailed view of one of the cam grooves.
Figure 20:
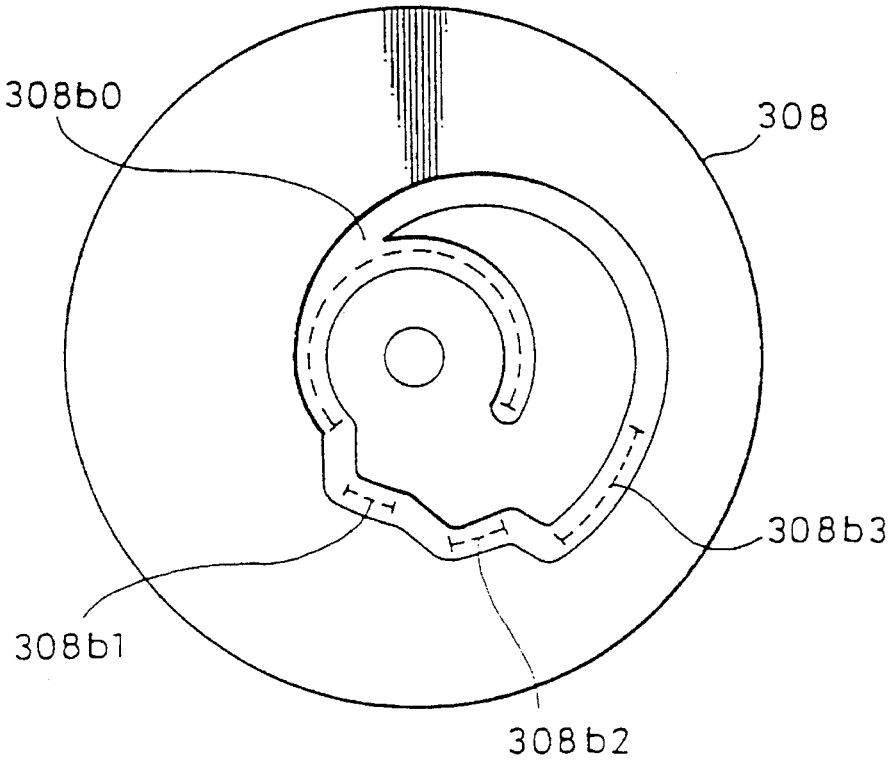
FIG. 20 is a detailed view of another of the cam grooves.
Figure 21:
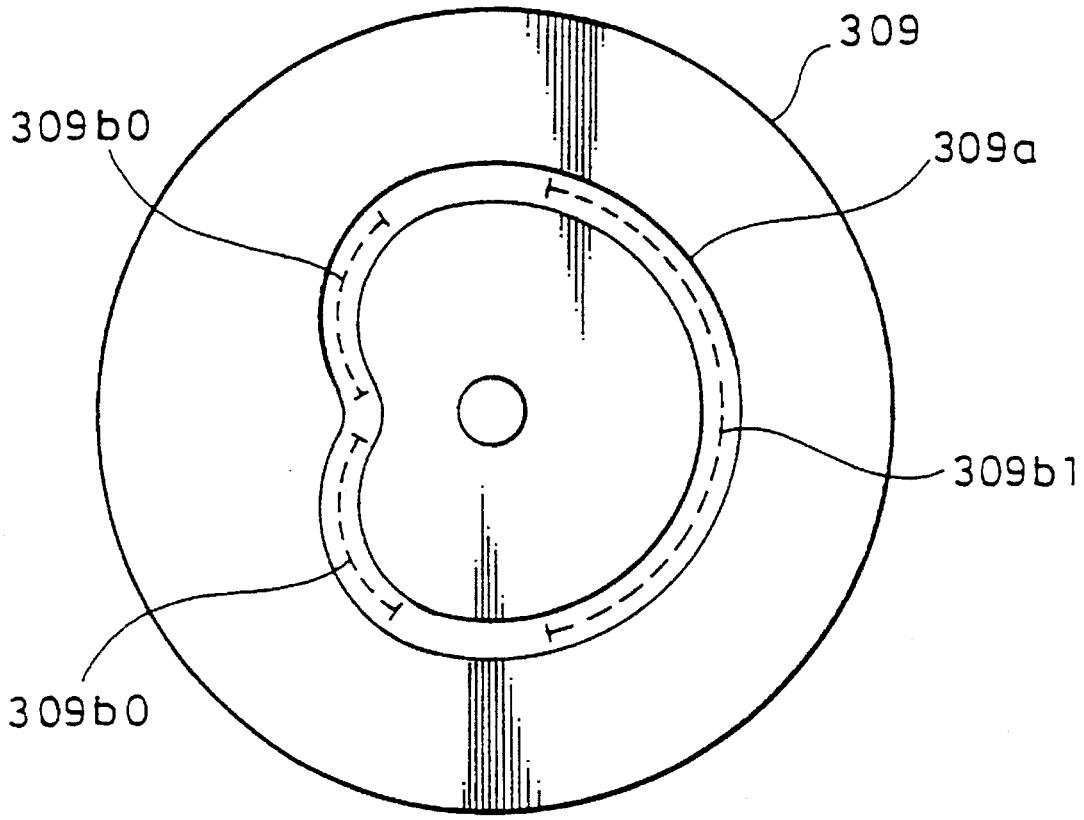
FIG. 21 is a detailed view of still another of the cam grooves.
Figure 22:
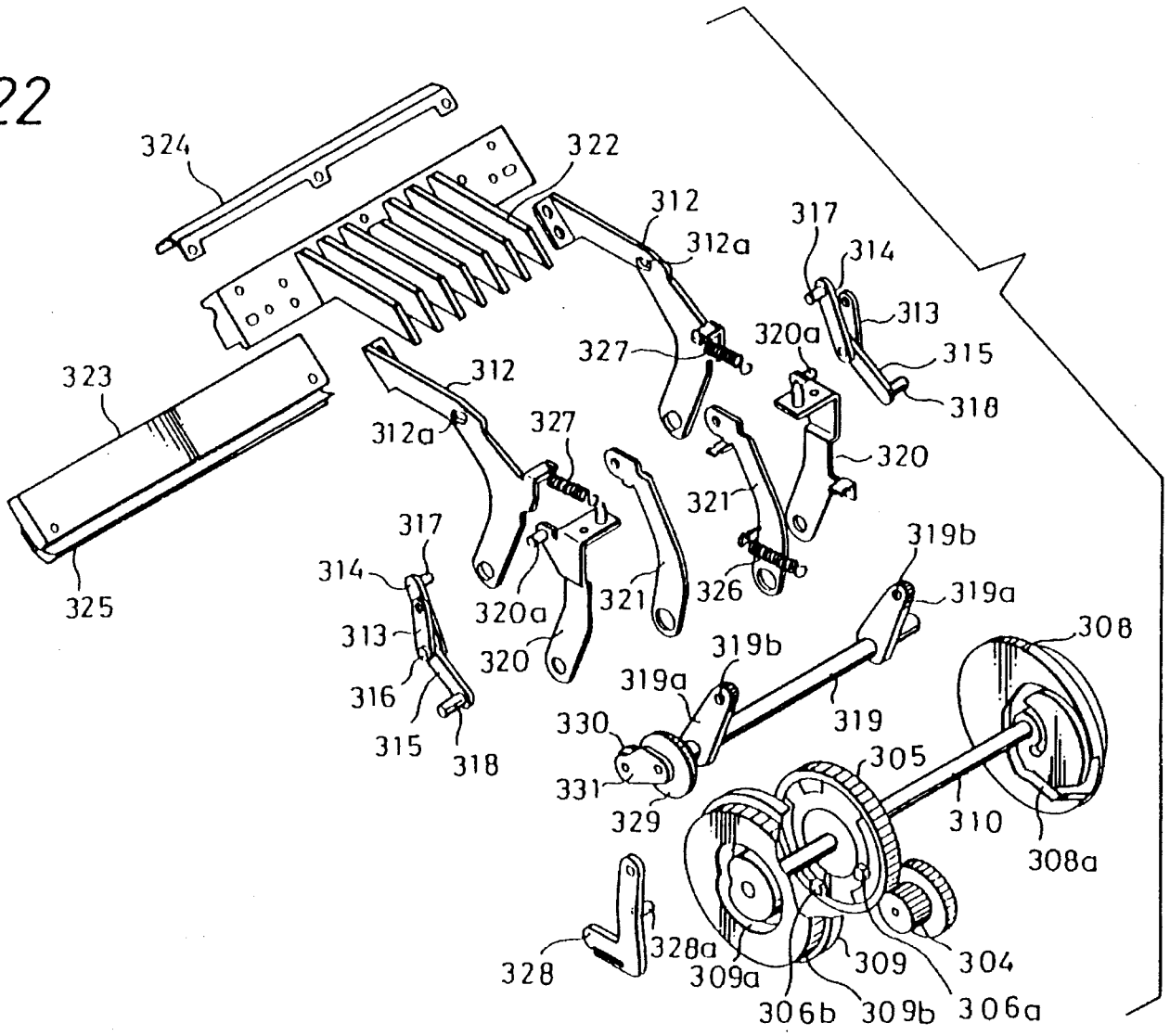
FIG. 22 is an exploded perspective view of a mechanism for actuating head arms.

As shown in FIG. 22, a cam gear 308 (hereinafter referred to as a "cam 308") and a cam gear 309 (hereinafter referred to as a "cam 309") are connected to the gear 305 by a shaft 310. As shown in FIGS. 19 and 20, the cam 308 has a cam groove 308*a* defined in an inner surface thereof for angularly moving one of a pair of head arms 312 (see FIG. 22), and a cam groove 308*b* defined in an outer surface thereof for angularly moving a change arm 142 (see FIG. 5). As shown in FIG. 21, the cam 309 has a cam groove (not shown) defined in an inner surface thereof for angularly moving the other head arm 312, and a cam groove 309*a* defined in an outer surface thereof for angularly moving a cam lever 328. The cam 309 also has a gear 309*b* (see FIG. 22) for transmitting rotation to a double gear 329. The cam groove 308*a* for angularly moving one of the head arms 312 and the non-illustrated cam groove of the cam 309 for angularly moving the other head arm 312 are paired with each other and operate in the same manner. Therefore, only the cam groove 308*a* will be described below.

Head position:

The gear 305 can be stopped in any of five predetermined positions. Angular movement of the gear 305 to these positions and a process of setting these positions will be described below with reference to FIG. 17A. In order to detect a reference position, the gear 305 is rotated clockwise, and stopped when the optical sensors 306*a*, 306*b* detect dark areas, i.e., the black areas 307*a*, 307*b*. This stopped position is referred to as a head position H0*a* (hereinafter simply referred to as "H0*a*"), which is a reference head position.

Movement to head positions for printing:

The gear 305 is rotated clockwise from H0*a*, and stopped when the optical sensor 306*a* detects a bright area. The stopped position is referred to H1*a*. Then, the gear 305 is rotated clockwise from H1*a*, and stopped when the optical sensor 306*a* detects a dark area, i.e., the black area 307*b*. The stopped position is referred to H2*a*. Then, the gear 305 is rotated clockwise from H2*a*, and stopped when the optical sensor 306*a* detects a bright area. The stopped position is referred to H3*a*. Then, the gear 305 is rotated clockwise from H3*a*, and stopped when the optical sensor 306*a* detects a dark area, i.e., the black area 307*c*. The stopped position is referred to H4. Thereafter, the gear 305 is rotated counterclockwise from H4, and after the sensor 306*a* has detected a bright area, the gear 305 is stopped when the optical sensor 306*a* detects a dark area, i.e., the black area 307*b*. The stopped position is referred to H3*b*. Then, the gear 305 is rotated counterclockwise from H3*b*, and stopped when the optical sensor 306*a* detects a bright area. The stopped position is referred to H2*b*. Then, the gear 305 is rotated counterclockwise from H2*b*, and stopped when the optical sensor 306*a* detects a dark area, i.e., the black area 307*a*. The stopped position is referred to H1*b*. Then, the gear 305 is rotated counterclockwise from H1*b*, and stopped when the optical sensor 306*a* detects a bright area. The stopped position is referred to H0*b*.

Figure 18A:
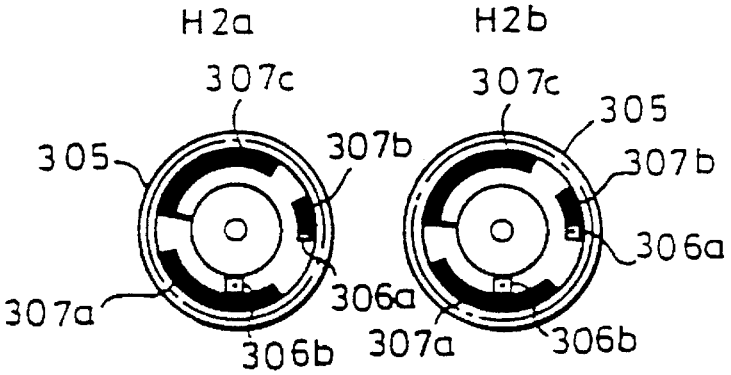
FIGS. 18A, 18B, 18C and 18D are diagrams showing the relationship between stop positions H2*a*, H2*b* of the gear and the angular positions of the cam grooves.
Figure 18B:
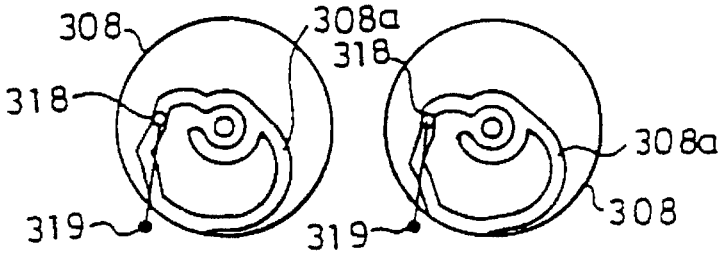
Figure 18C:
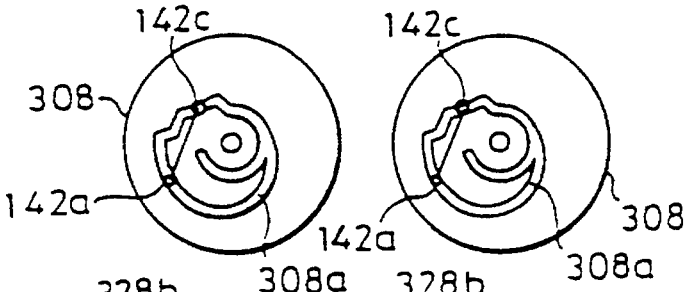
Figure 18D:
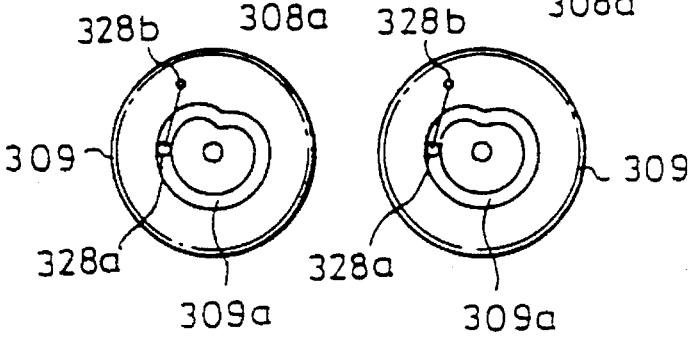

FIG. 18A shows the positional relationship between the gear 305, the optical sensor 306*a*, and the optical sensor 306*b* in the head positions H2*a*, H2*b*. FIG. 18B shows the positional relationship between the cam groove 308*a* and a pin 318 on a link 315 connected to one of the head arms 312. FIG. 18C shows the positional relationship between the cam groove 308*b* and a pin 142*a* on the change arm 142. FIG. 18D shows the positional relationship between the cam groove 309*a* and a pin 328*a* on the cam lever 328.

The motor 300 is de-energized immediately after the head position H2*a* or H2*b* is detected. Therefore, any difference between the positions H2*a*, H2*b* where the gear 305 is stopped is small. Comparison between the positions H2*a*, H2*b* indicates that since the pins are positioned within the same radial profiles on the cams, the relative positions of the pins in the positions H2*a*, H2*b* with respect to the centers of the cams are the same as each other. In the positions H2*a*, H2*b*, since the cam follower 320, the cam lever 328, and the change arm 142 are in the same positions. Therefore, the positions H2*a*, H2*b* can be regarded as identical to each other in terms of printer control. Therefore, the positions H2*a*, H2*b* will hereinafter be collectively described as a position H2.

Similarly, the pins are stopped in the same radial profiles on the cams in the positions H0*a*, H0*b*, the positions H1*a*, H1*b*, and the positions H3*a*, H3*b*. Consequently, the positions H0*a*, H0*b*, the positions H1*a*, H1*b*, and the positions H3*a*, H3*b* will hereinafter be collectively described as positions H0, H1, H3, respectively. The position H4 is detected only when the gear 305 is rotated clockwise.

Figures 17A, 17B, 17C, 17D:
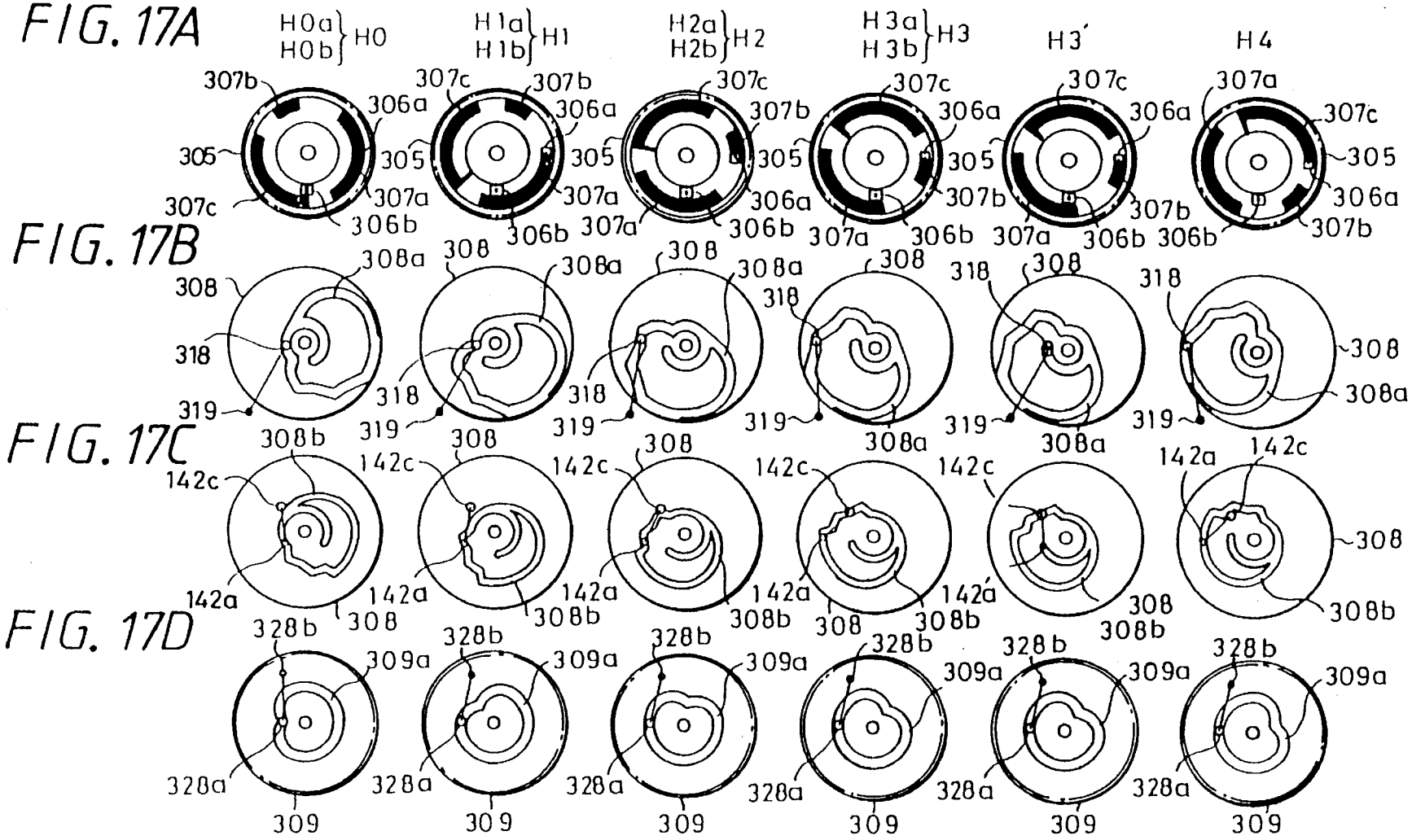
FIGS. 17A, 17B, 17C and 17D are diagrams showing the relationship between stop positions H0~H4 of a gear and angular positions of cam grooves.

The positional relationship between the cam groove 308*a* and the pin 318 on the link 315 connected to the head arm 312 in each of the positions H0~H4 of the gear 305 is shown in FIG. 17B. The positional relationship between the cam groove 308*b* and the pin 142*a* on the change arm 142 in each of the positions H0~H4 of the gear 305 is shown in FIG. 17C. The positional relationship between the cam groove 309*a* and the pin 328*a* on the cam lever 328 in each of the positions H0~H4 of the gear 305 is shown in FIG. 17D.

Movement to head positions for reading the ribbon code:

After the reference position H0 has been detected, the gear 305 is rotated counterclockwise. After the optical sensor 306*a* has detected the black area 307*a* in the reference position H0, it detects a bright area, then the black area 307*b*, and thereafter the black area 307*c* whereupon the gear 305 is stopped. This stopped position is referred to as H3'. The position H3' is the same as the position H3 insofar as the gear 305 is stopped therein. Since the cam surfaces 308*a*, 308*b* act differently in the position H3' than in the position H3, the position H3' is distinguished from the position H3. After the position H3' has been detected, the gear 305 is rotated clockwise back to the reference position H0.

Operation of the cams 308, 309:

The configurations of the cam grooves 308*a*, 308*b*, 309*a* will be described below with reference to FIGS. 19 through 21.

In FIG. 19, the cam groove 308*a* comprises passages 308*a*0, 308*a*1, 308*a*2, 308*a*3 lying on circles concentric with the center of rotation of the cam 308, curved passages smoothly interconnecting the passages 308*a*0, 308*a*1, the passages 308*a*1, 308*a*2, the passages 308*a*2, 308*a*3, and a curved passage smoothly interconnecting the passage 308*a*3 and an intermediate portion of the passage 308*a*0. The pin 318 on the link 315 is stopped in the passage 308*a*0 when the gear 305 is in the positions H0, H1, H3', in the passage 308*a*1 when the gear 305 is in the position H2, in the passage 308*a*2 when the gear 305 is in the position H3, and in the passage 308*a*3 when the gear 305 is in the position H4.

In FIG. 20, the cam groove 308*b* comprises passages 308*b*0, 308*b*1, 308*b*2, 308*b*3 lying on circles concentric with the center of rotation of the cam 308, curved passages smoothly interconnecting the passages 308*b*0, 308*b*1, the passages 308*b*1, 308*b*2, the passages 308*b*2, 308*b*3, and a curved passage smoothly interconnecting the passage 308*b*3 and an intermediate portion of the passage 308*b*0. The pin 142*a* on the change arm 142 is stopped in the passage 308*b*0 when the gear 305 is in the positions H0, H3', in the passage 308*b*1 when the gear 305 is in the position H1, in the passage 308*b*2 when the gear 305 is in the position H2, and in the passage 308*b*3 when the gear 305 is in the positions H3, H4.

In FIG. 21, the cam groove 309*a* comprises passages 309*b*0, a passage 309*b*1 lying on a circle concentric with the center of rotation of the cam 309, and curved passages smoothly interconnecting opposite ends of the passages 309*b*0, 309*b*1. The pin 328*a* on the cam lever 328 is stopped in the passages 309*b*0 when the gear 305 is in the position H0, and in the passages 309*b*1 when the gear 305 is in the positions H1, H2, H3, H3', H4.

Head positions and operation of the cams:

Initial operation

As the gear 305 rotates in order to detect the reference position 0, the cams 308, 309 rotate clockwise. The passage 308*a*0 of the cam groove 308*a* has a branch point 308*a*4 for branching off toward the passage 308*a*3, and the passage 308*b*0 of the cam groove 308*b* has a branch point 308*b*4 for branching off toward the passage 308b3. Upon clockwise rotation, the pins 318, 142a do not interfere with the rotation of the cams 308, 309 at these branch points 308a4, 308b4.

Structure of head arm 312:

As shown in FIG. 22, the head arms 312 are angularly movably supported on a shaft 319, on which there are angularly movably supported a pair of levers 320 and a pair of arms 321. A pair of fixed plates 311 (see FIG. 3) whose portions are fixed to the top plate 404 is also mounted on the shaft 319. The shaft 319 is supported on the chassis 401. A pair of cam followers 319a is fixedly mounted on the shaft 319.

The levers 320 have respective pins 320a coupled to respective links 313 which are coupled to links 314 and the links 315 by pins 316. The links 314 have pins 317 extending through respective slots 312a defined in the respective head arms 312. The pins 318 on the links 315 extend through respective holes 319b defined in the cam followers 319a and engage respectively in the cam groove 308a of the cam 308 and the non-illustrated corresponding cam groove of the cam 309. The head arms 312 are positioned between the links 314 and the arms 321 that are coupled to each other by the pins 316. The pins 317 are connected to the respective arms 321 through the slots 312a in the head arms 312. The head arms 312 and the arms 321 are normally urged toward each other by springs 327, but their relative angular displacement about the shaft 19 is limited by the pins 317 in the slots 312a.

The arms 321 are normally biased by springs 326 in a direction to move the cam followers 319a toward the center of the cams 308, 309. A heat sink 322 is attached to the head arms 312. A head 323 and a ribbon guide 324 which doubles as a reflecting mirror are attached to the head sink 322.

The head 323 has a head cover 325, an array of heating elements (not shown), and a plurality of electric wires (not shown) for supplying electric currents to the heating elements.

Movement of head 323:

Movement of the head 323 will be described below with reference to FIGS. 23A through 23D. The head 323 can be stopped in any of four positions.

Figure 23A:
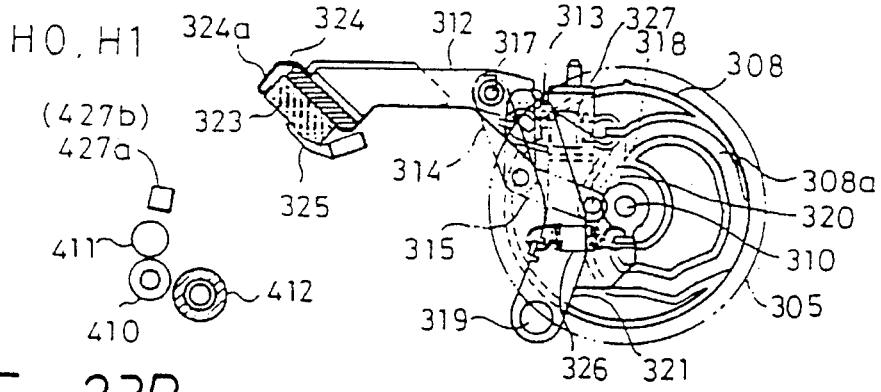
FIGS. 23A, 23B, 23C and 23D are diagrams showing the positional relationship between the one cam groove and a head in respective operating phases.

When the gear 305 is stopped in the positions H0, H1, the head 323 is in a standby position, as shown in FIG. 23A.

Figure 23B:
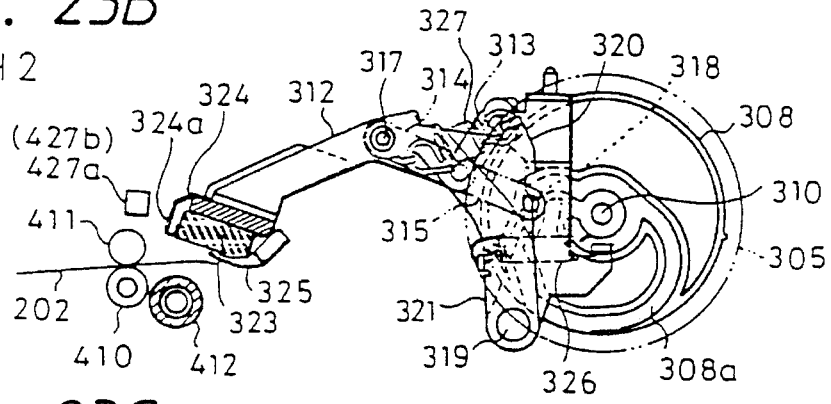

As shown in FIG. 23B, when the gear 305 is angularly moved to the position H2, the head 303 moves a flat surface 324a of the ribbon guide 324 to a position in front of optically reflective ribbon mark sensors 427a, 427b that are mounted on the inlet guide 426 (see FIG. 4).

A process of detecting the header mark 11 and the patch marks 12 on the ink ribbon 10 will be described below.

The ribbon guide 324 comprises a stainless sheet which is processed into a mirror finish having a high optical reflectance. The header mark 11 and the patch marks 12 on the ink ribbon 10 are in the form of strips having low optical transmittance and reflectance. Since the other areas of the ink ribbon 10 than the header mark 11 and the patch marks 12 have a higher optical transmittance, when the other areas of the ink ribbon 10 are present between the sensors 427a, 427b and the flat surface 324a, the sensors 427a, 427b detect those ink ribbon areas or the flat surface 324a as a bright area, and when the header mark 11 and the patch marks 12 are present between the sensors 427a, 427b and the flat surface 324a, the sensors 427a, 427b detect those marks as a dark area.

Inasmuch as the header mark 11 extends as a strip fully across the ink ribbon 10, both the sensors 427a, 427b can detect the header mark 11 as a dark area. On the other hand, since the patch marks 12 extend as a strip about a half the width of the ink ribbon 10, including the detectable range of the sensor 427a, when the sensor 427a detects the patch marks 12 as a dark area, the sensor 427b detects the other ink ribbon areas as a bright area.

Figure 23C:
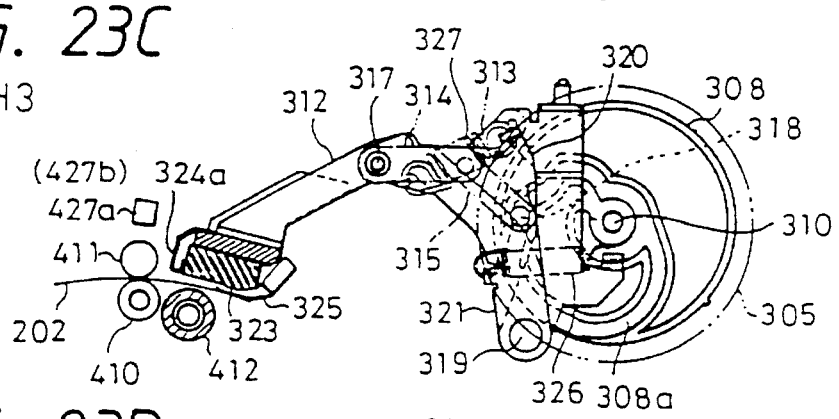

When the gear 305 is angularly moved to the position H3 as shown in FIG. 23C, the head 323 is moved to a position that is spaced from the platen 412 by a small gap. Upon movement of the head 323 to the position H3, the printer changes sheet feed paths as will be described later in detail.

Figure 23D:
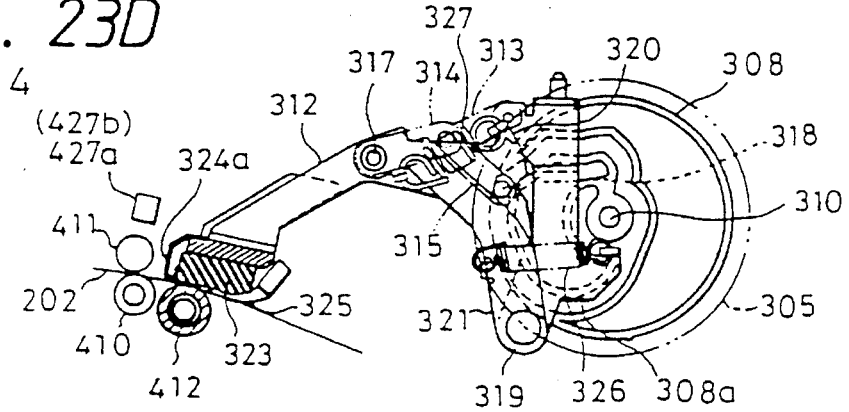

When the gear 305 is angularly moved to the position H4 as shown in FIG. 23D, the head 323 is pressed against the platen 412. The links are moved by the cam 308 to cause the arms 321 turn the head arms 312 toward the platen 412 until the head 323 is brought into contact with the platen 412. Thereafter, though the arms 321 are turned by the cam 308, since the head arms 312 cannot be turned due to the head 323 already in contact with the platen 412, the arms 321 and the head arms 312 are angularly moved with respect to each other to release the pins 317 from limited engagement in the slots 321a in the head arms 321, whereupon the head arms 312 press the head 323 against the platen 412 under the bias of the springs 327.

Structure of change arm 142:

The change arm 142 can be angularly moved by the cam groove 308b, and can be stopped in any of four positions shown in FIGS. 24A through 24D. The change arm 142 causes a cam groove 142b defined therein to actuate a lock finger 143 and a brake finger 144 which are angularly movably supported on the bracket 100 by a pivot shaft 142c. The lock finger 143 can engage the gear 146a of the supply reel base 146 to prevent the gear 146a from rotating, and the brake finger 144 can engage the gear 145 of the supply reel base 146 to prevent the gear 145 from rotating. The change arm 142 can also actuate the link 149 that is coupled thereto by a shaft 149c. The link 149 has a slot 149b which is guided by the shaft 146c of the supply reel base 146. As the link 149 is moved, the tip end 149a thereof can bring the pendulum gear 124 into and out of mesh with the gear 145.

Figure 24A:
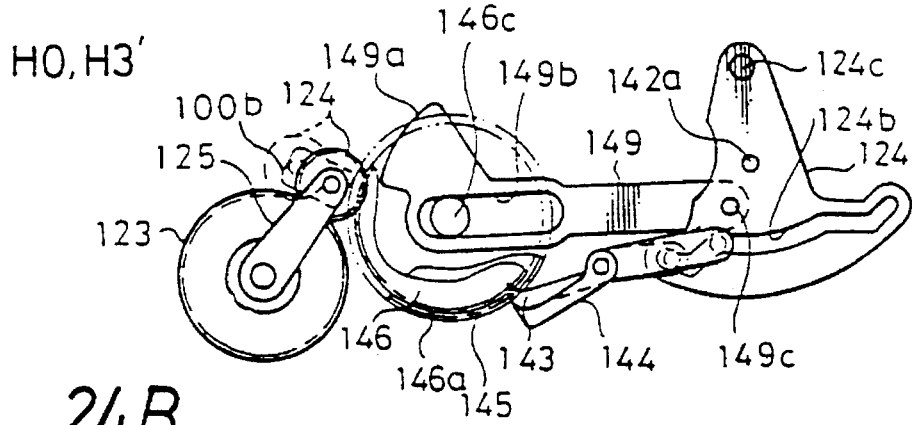
FIGS. 24A, 24B, 24C and 24D are diagrams showing the manner in which a change arm operates.

In FIG. 24A, the gear 305 is angularly moved to the positions H0, H3'. In the positions H0, H3', the lock finger 143 engages the gear 146a, the brake finger 144 disengages from the gear 145, and the link 149 does not limit movement of the pendulum arm 125.

Figure 24B:
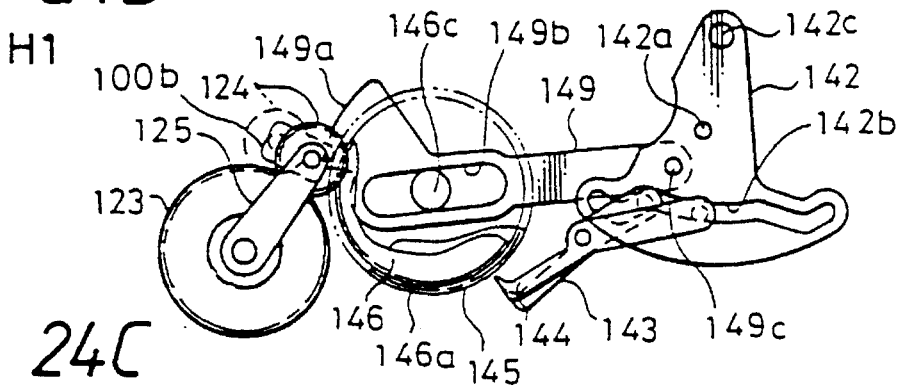

In FIG. 24B, the gear 305 is angularly moved to the position H1. In the position H1, both the lock finger 143 and the brake finger 144 disengage from the respective gears 146a, 145, and the link 149 does not limit movement of the pendulum arm 125.

Figure 24C:
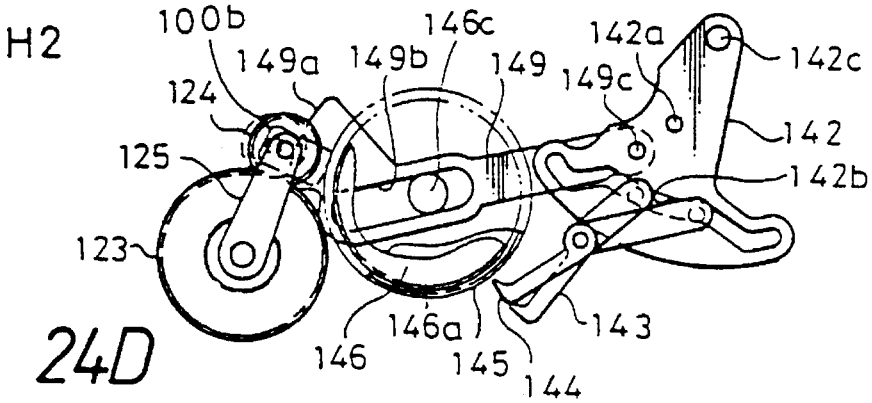

In FIG. 24C, the gear 305 is angularly moved to the position H2. In the position H1, both the lock finger 143 and the brake finger 144 disengage from the respective gears 146a, 145, and the link 149 limits movement of the pendulum arm 125.

Figure 24D:
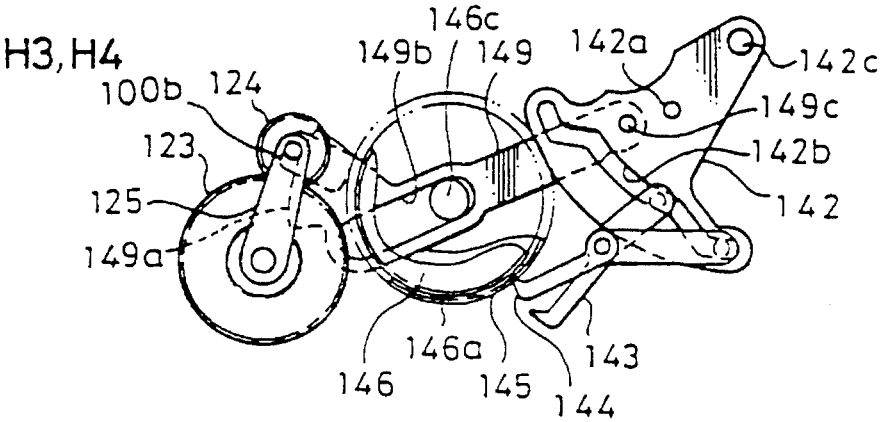

In FIG. 24D, the gear 305 is angularly moved to the positions H3, H4. In the positions H3, H4, the lock finger 143 disengages from the gear 146a, the brake finger 144 engages the gear 145, and the link 149 limits movement of the pendulum arm 125.

Figure 25A:
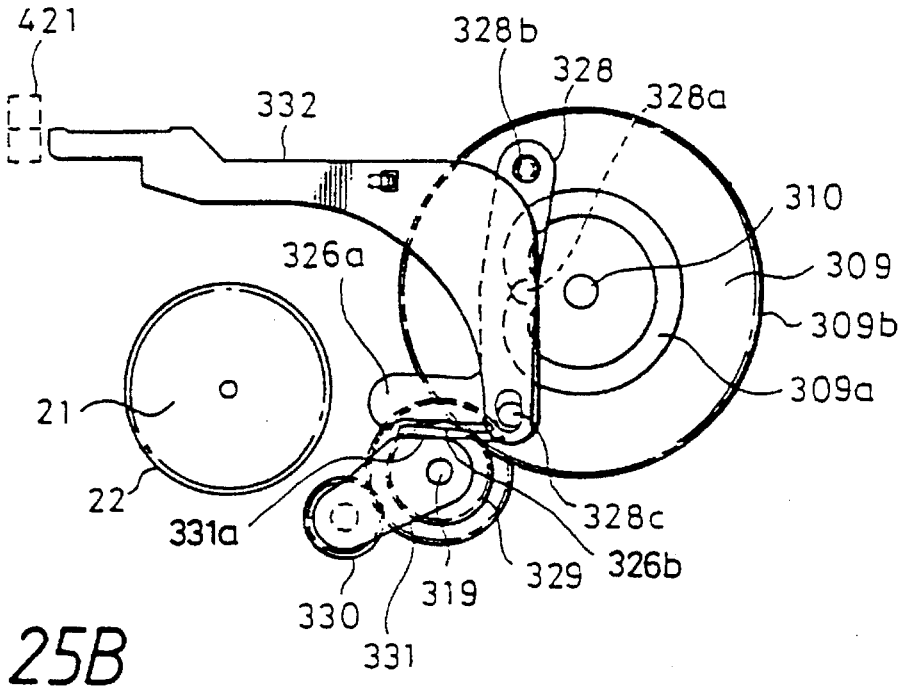
FIGS. 25A and 25B are diagrams showing the manner in which the still other cam groove, a pendulum gear, and a lock lever operate.
Figure 25B:
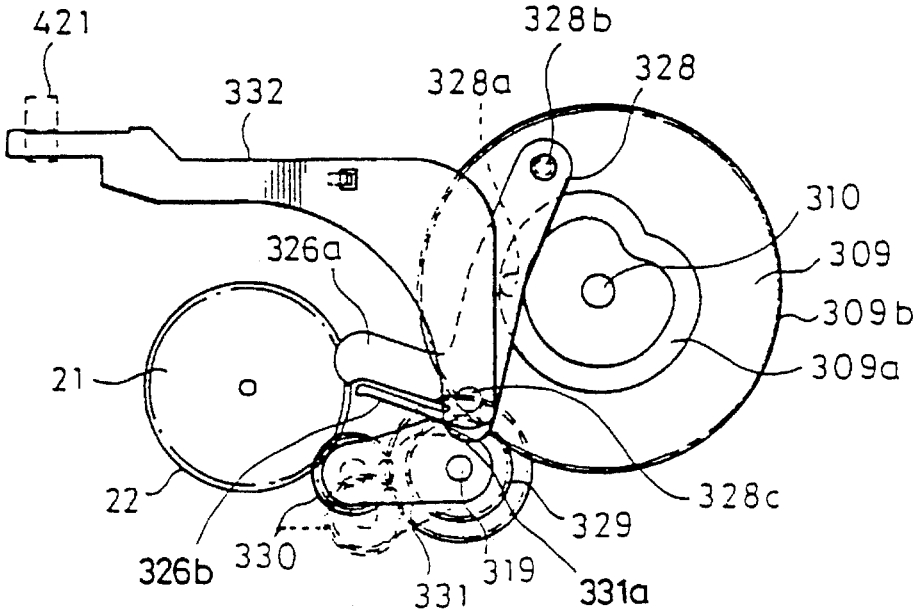

Structure of cam lever 328:

The cam lever 328 can be angularly moved about a pivot shaft 328b by the cam groove 309a, and can be stopped in any of two positions shown in FIGS. 25A and 25B. The cam lever 328 has a top end 326a for limiting movement of a pendulum arm 331. The cam lever 328 can slide the lock lever 32 slidably supported on the ribbon door holder 422 (see FIG. 9) upon movement of the pin 328c on the cam lever 328 along the cam groove 309a.

Structure of pendulum gear 330:

A pendulum gear 330 is rotatably mounted on the pendulum arm 331, which is held in frictional contact with the pendulum gear 330 under frictional forces developed by a spring (not shown). When the cam 308 rotates clockwise in FIGS. 25A and 25B, the rotation of the cam 308 is transmitted from the gear 309*b* on the cam 309 to a double gear 329 rotatably mounted on an end of the shaft 319. The pendulum arm 331, which is angularly movably supported on the shaft 319, is turned clockwise, bringing the pendulum gear 330 into mesh with the gear 22 of the code ring 21 of the ribbon cassette 1 thereby to rotate the code ring 21.

In FIG. 25A, the gear 305 is in the position H0. The cam lever 328 prevents the pendulum arm 331 from bringing the pendulum gear 330 into mesh with the gear 22. The lock lever 332 is retracted, allowing the ink ribbon door 420 to be opened.

In FIG. 25B, the gear 305 is in the positions H1, H2, H3, H3', H4 The cam lever 328 does not limit the pendulum arm 331, permitting the pendulum gear 330 to mesh with the gear 22. The lock finger 421 is locked by the lock lever 322, making it impossible to open the ink ribbon door 420.

A process of rotating the ribbon code ring 21, which is a central feature of the present invention, will be described below.

After the gear 305 has been brought to the position H0, the gear 305 is rotated clockwise to the position H3', and then rotated counterclockwise back to the position H0. Upon movement from the position H3' to the position H3, the pendulum gear 330 meshes with the gear 22 as shown in FIG. 25B, thus rotating the ribbon code ring 21, and the information mark 23 is read by a sensor 335 (see FIG. 2). When the above clockwise and counterclockwise rotation of the gear 305 is repeated twice, the ribbon code ring 21 makes two revolutions.

Even if one information mark 23 is employed, since the ribbon code ring 21 makes two revolutions, the information mark 23 can always be read once by the sensor 335 irrespective of the position where the header bit of the ribbon code ring 21 is stopped.

During the above operation, since the pins 318 on the head arms 312 move in the passage 308*a*0 of the cam groove 308*a* in the cam 308 and the corresponding passage of the cam groove in the cam 309, the head arms 312 are not moved. Similarly, since the pin 142*a* on the change arm 142 moves in the passage 308*b*0 of the cam groove 308*b*, the change arm 142 is not moved. Therefore, only those parts of the printer which are actuatable by the cam groove 308*b* are moved, and the parts remain stopped. While the information mark 23 is being read, the ink ribbon door 420 is locked against being opened, thus preventing a readout error from occurring in reading the information mark 23 which would otherwise happen if the user opened the ink ribbon door 420 and touched the ribbon cassette 1.

A series of operations of a printing process will be described below also with reference to FIGS. 26 through 31.

Figure 26:
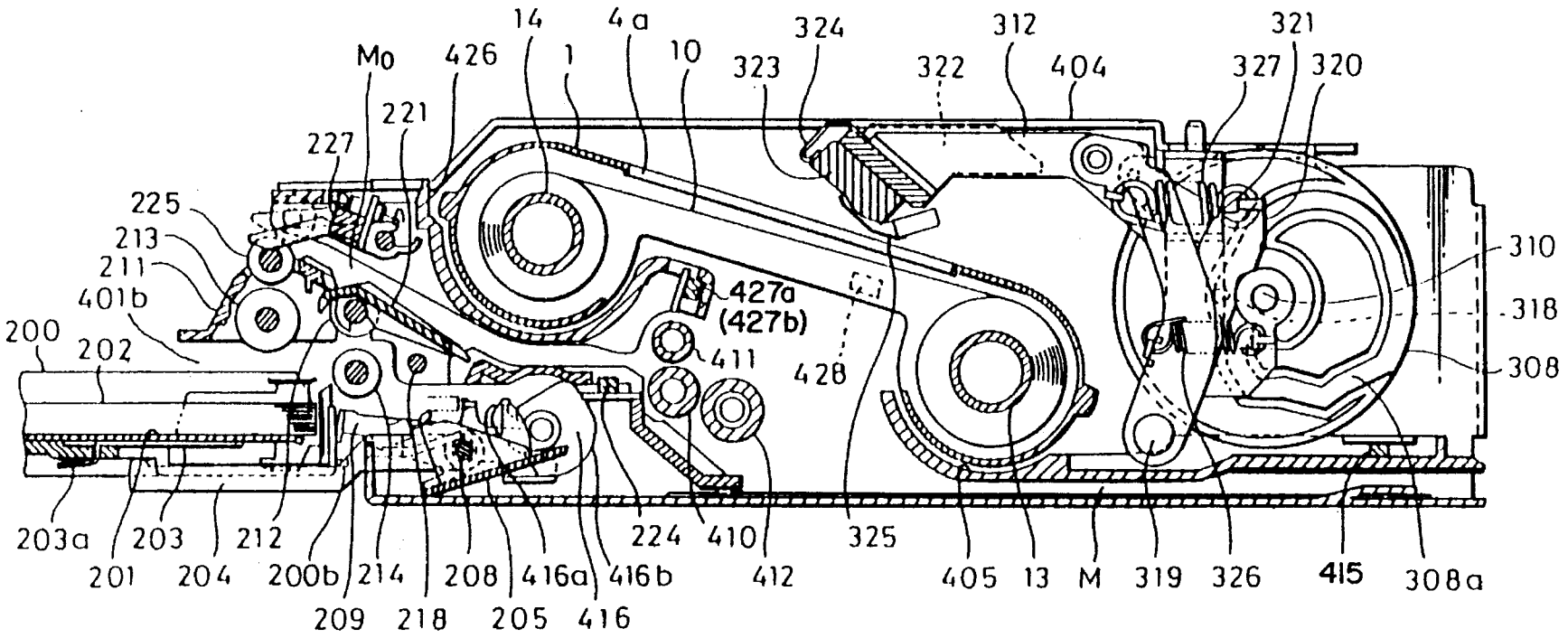
FIG. 26 is a view showing the manner in which the printer operates in a head position H0 and a sheet position P0.

Initialization:

When the power supply switch of the printer is turned on, the following initializing operations are carried out:

Sheet position initialization:

It is confirmed that the gear 118 is in the sheet position P0 as shown in FIG. 26. If the gear 118 is not in the sheet position P0, then the motor 101 is energized to turn the gear 118 to the sheet position P0.

Head position initialization:

It is confirmed that the gear 305 is in the head position H0 as shown in FIG. 26. If the gear 305 is not in the sheet position H0, then the motor 300 is energized to turn the gear 335 to the head position H0. If the sheet and head positions P0, H0 cannot be confirmed, then the printer is judged as suffering a failure.

Confirmation of ink ribbon 10 and ribbon code readout:

It is confirmed with a switch (not shown) that the ink ribbon door 420 is closed, and it is also confirmed with a switch 428 that the ribbon cassette 1 is loaded. If confirmed, then the motor 300 is reversed to cause the gear 309*b* of the cam 309 to move the double gear 329 and the pendulum gear 330 to rotate the ribbon code ring 21, and the information code 23 is read by the sensor 335. If the read information code 23 is not in conformity with any of various information codes that have been stored in the printer, it is determined that there is no ribbon cassette loaded, and a warning is issued.

If the switch (not shown) for detecting the ink ribbon door 420 and the switch 428 for detecting the ribbon cassette 1 are turned on and off while the printer is in a standby condition, then it is determined that the ribbon cassette 1 has been replaced, and the information code 23 is read again.

Printing operation:

A printing operation is started as when a switch is pressed.

Confirmation of sheet feed tray 200 and print sheet:

It is confirmed with a switch 429 (see FIG. 3) that the sheet feed tray 200 is installed, and it is also confirmed with sensors 430*a*, 430*b* that there is a print sheet 202 in the sheet feed tray 200. If not confirmed, it is determined that no print sheet is loaded, and a warning is issued.

Figure 27:
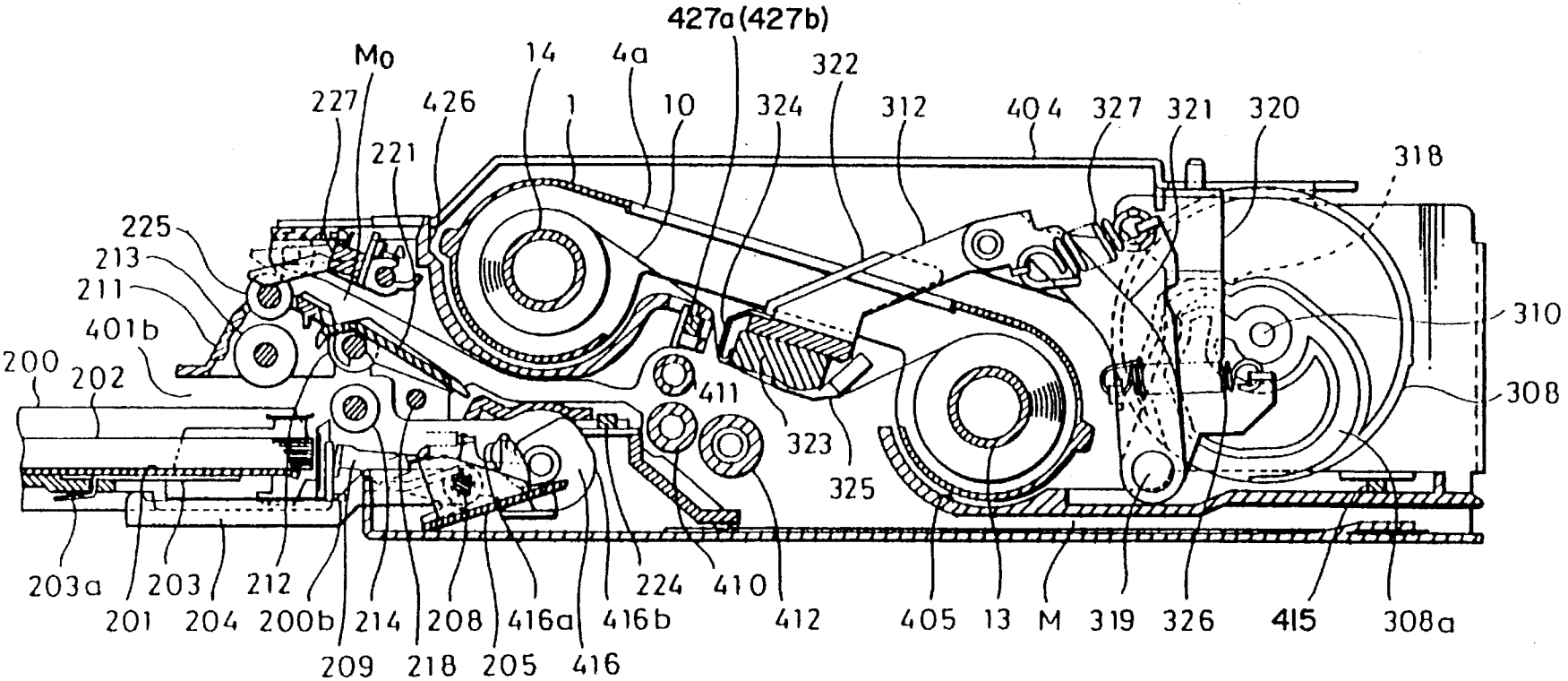
FIG. 27 is a view showing the manner in which the printer operates in a head position H2 and the sheet position P0.

Bringing ink ribbon head into operative position and movement toward head position:

The gear 305 is rotated from the head position H0 shown in FIG. 26 into the head position H2 shown in FIG. 27. Until the sensors 427*a*, 427*b* detect the header mark 11 of the ink ribbon 10, the motor 101 is energized to rotate the takeup reel base 111 to wind the ink ribbon 10 for thereby bringing the head of the ink ribbon 10 into an operative position. The motor 101 is continuously energized for a preset period of time. If the header mark 11 is not detected even when the motor 101 is continuously energized for the preset period of time, then it is determined that no remaining length of ink ribbon is available, and a warning is issued.

Figure 28:
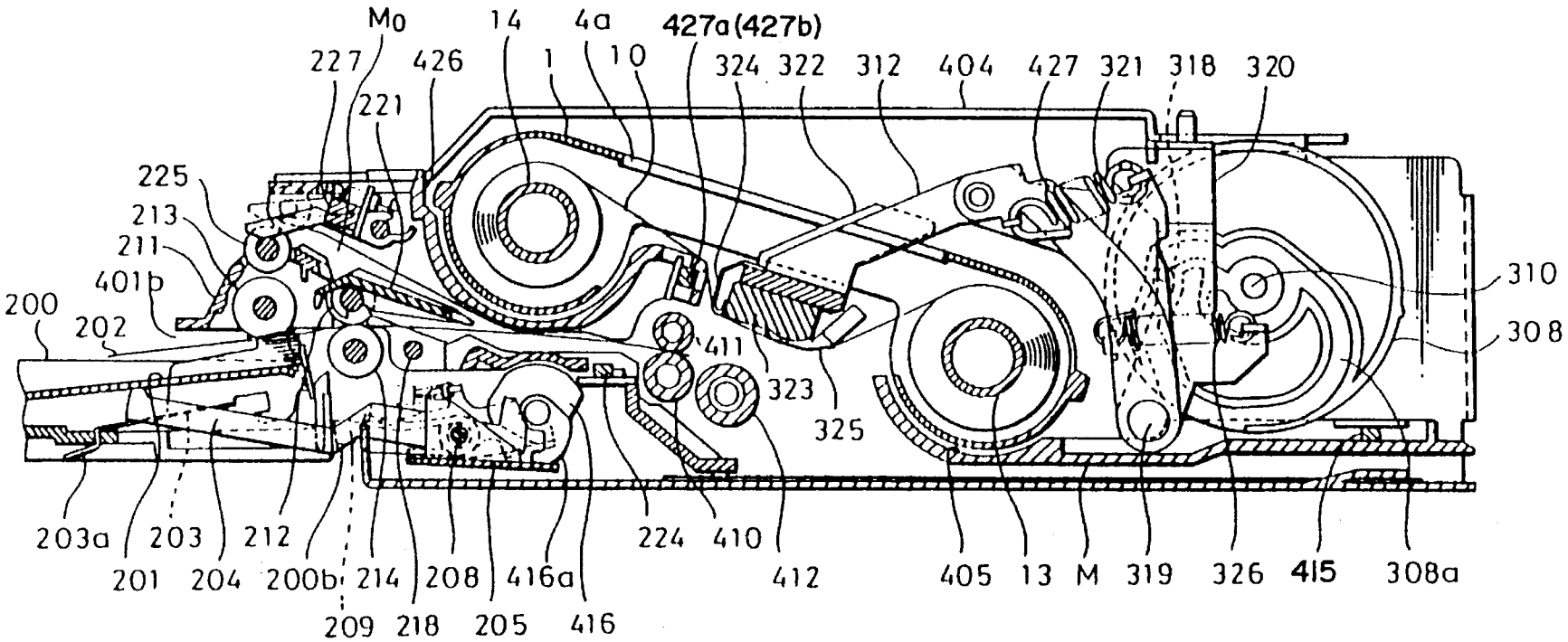
FIG. 28 is a view showing the manner in which the printer operates in the head position H2 and a sheet position P1.

Movement to sheet position:

The motor 101 is energized to rotate the gear 118 from the sheet position P0 to the sheet position P1 shown in FIG. 28. Specifically, the gear 118 is rotated counterclockwise by the motor 101 to turn the sheet feed cam 416 for thereby causing the pressing plate 205 to lift the sheet feed arm 204. A print sheet 202 is elevated into abutment against the sheet feed roller 213. At this time, the lock finger 209 is released from the cam surface 416*b* and engages in the hole 200*a* in the sheet feed tray 200, thus locking the sheet feed tray 200. Simultaneously, respective cam surface 417*b* of the release cam 417 cause the pinch roller arms 413 to move the pinch roller 411 away from the capstan 410.

Upon rotation of the gear 118, respective cam surfaces 417*a* of the release cams 417 turn the release lever 222, causing the turn plate 215 to bring the separating roller 214 into abutment against the sheet feed roller 213. At this time, the release lever 222 is turned to open the shutter 221.

The print sheet 202 is now drawn in by the sheet feed roller 213, gripped between the sheet feed roller 212 and the separating roller 214, and delivered through the open shutter 221 into the printer. While the print sheet 202 is being fed under this condition, since the pinch roller arms 413 are released from the cam surfaces 417*b* of the release cams 417, the pinch roller 411 is held in pressed contact with the capstan 410 under the bias of the spring 414.

Figure 3:
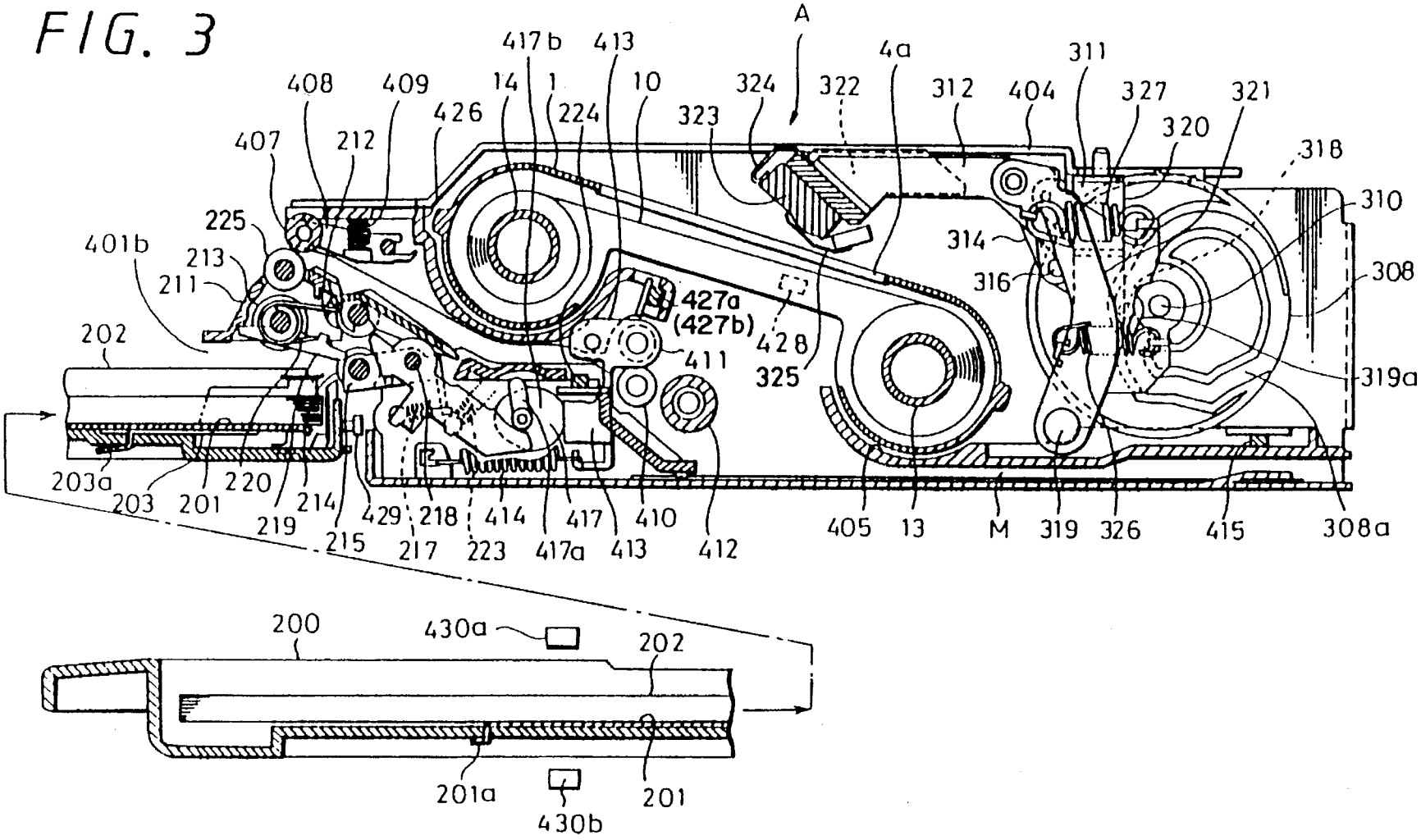
FIG. 3 is a cross-sectional view of the printer, taken along a plane across a cam.

Feeding of print sheet and detection by sheet feed sensor 224:

The stepping motor 102 is energized to feed the print sheet 202 until it is detected by the sheet feed sensor 224 (see FIGS. 3 and 4). If no print sheet is detected by the sheet feed sensor 224 after the stepping motor 102 has been energized for a predetermined interval, then the printer is judged as suffering a sheet feed error, and a warning is issued.

Movement to sheet position:

When the print sheet 202 is fed for a predetermined interval from a reference position in which the leading end of the print sheet 202 is detected by the sheet feed sensor 224, the print sheet 202 is gripped between the capstan 410 and the pinch roller 411. Thereafter, the motor 101 is energized to rotate the gear 118 from the sheet position P1 shown in FIG. 28 to the sheet position P2 shown in FIG. 29.

Dropping of print sheet and movement to head position:

When the print sheet 202 is fed for a predetermined interval from the reference position in which the leading end of the print sheet 202 is detected by the sheet feed sensor 24, the leading end of the print sheet 202 is positioned beneath the head cover 325. While the leading end of the print sheet 202 is being positioned beneath the head cover 325, the motor 300 is energized to rotate the gear 305 from the position H2 shown in FIGS. 23B, 28 to the position H3 shown in FIGS. 23C, 29. The leading end of the print sheet 202 which has been directed substantially toward the center of the supply reel base 146 is pressed by the head cover 325 and changes its direction of movement toward a passage M defined between the chassis 401 and a guide 406. Further delivery of the print sheet 202 leads the leading end thereof into the passage M.

Detection by sensor 415:

When the print sheet 202 is further fed along, the leading end thereof is detected by a sensor (jamming sensor) 415 disposed in the passage M. The sensor 415 and the sheet feed sensor 224 are spaced from each other by a distance (e.g., 128 mm) which is somewhat smaller than the length of a sheet that can be used (e.g., 140.8 mm for a dedicated print sheet and 148 mm for a postal card).

If the leading end of the print sheet 202 is not detected by the sensor 415 after the print sheet 202 has been fed for a predetermined interval from the sheet feed sensor 224, then the printer is judged as suffering a sheet feed error, and a warning is issued.

Detection of print sheet trailing end by sheet feed sensor 224:

When the print sheet 202 is further fed along, the trailing end thereof is detected by the sensor 224. The length of the print sheet in the direction in which it is fed is determined from the number of steps that the stepping motor 102 is energized after the leading end of the print sheet 202 is detected by the sheet feed sensor 224 until the trailing end of the print sheet 202 is detected by the sheet feed sensor 224. The type of the print sheet 202 is identified, or the print sheet 202 may be determined as a sheet other than standard print sheets, by comparing the detected length of the print sheet 202 with the lengths of print sheets depending on predetermined types of print sheets. If the print sheet 202 is not of a predetermined standard type, or the detected type of the print sheet 202 disagrees with the type of the ink ribbon as identified from the information code 23 on the ribbon cassette 1, then a warning is issued.

Skipping of print sheet by 3 mm:

After the trailing end of the print sheet 202 is detected by the sheet feed sensor 224, the print sheet 202 is fed by 3 millimeters for detection by the sheet feed sensor 224. If any print sheet end is detected again by the sheet feed sensor 224, then the previous detection by the sheet feed sensor 224 is determined as being caused by a printed image or a stain on the reverse side of the print sheet 202, and the second detected print sheet end is regarded as a true trailing end of the print sheet 202.

Movement of print sheet toward print position:

By feeding the print sheet 202 a predetermined distance (few millimeters) from the position in which the trailing end of the print sheet 202 is detected by the sheet feed sensor 224, the print sheet 202 is moved to a print position, in which the print sheet 202 is stopped.

Figure 29:
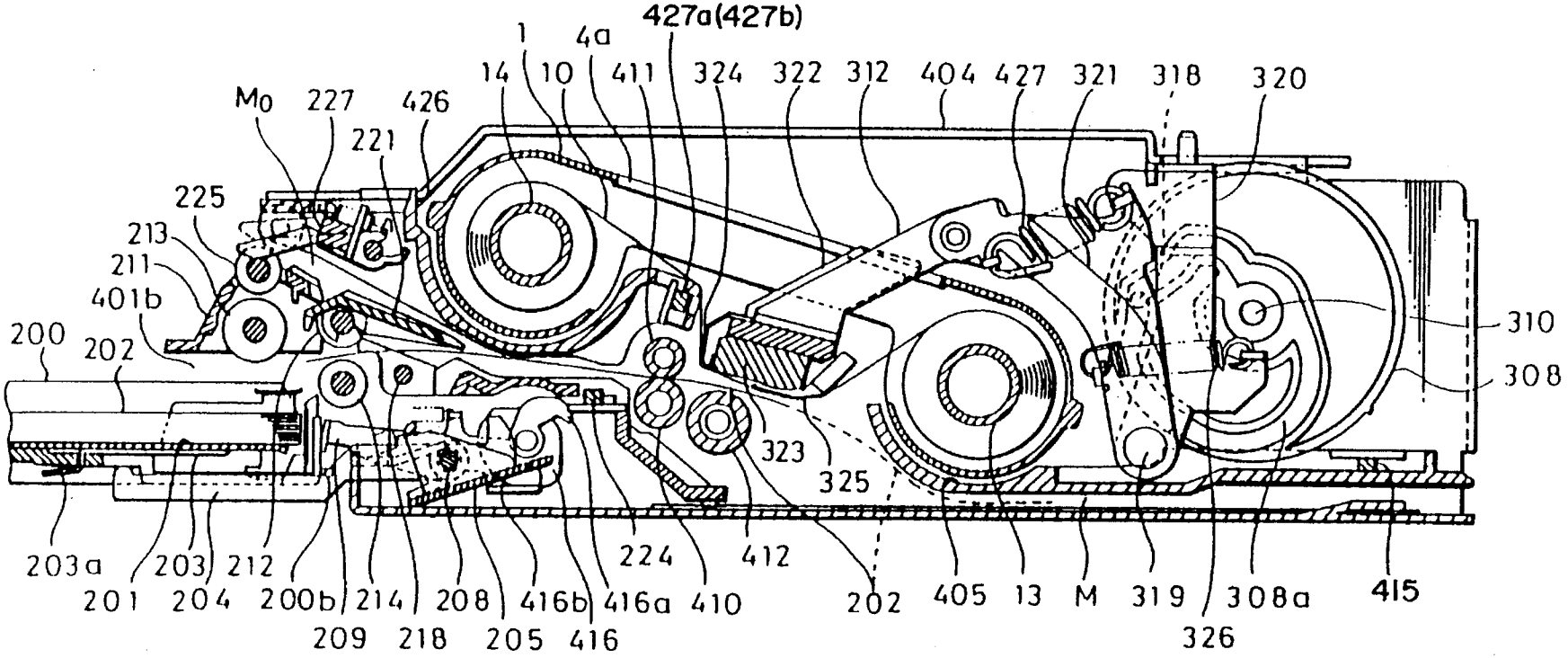
FIG. 29 is a view showing the manner in which the printer operates in a head position H3 and a sheet position P2.
Figure 30:
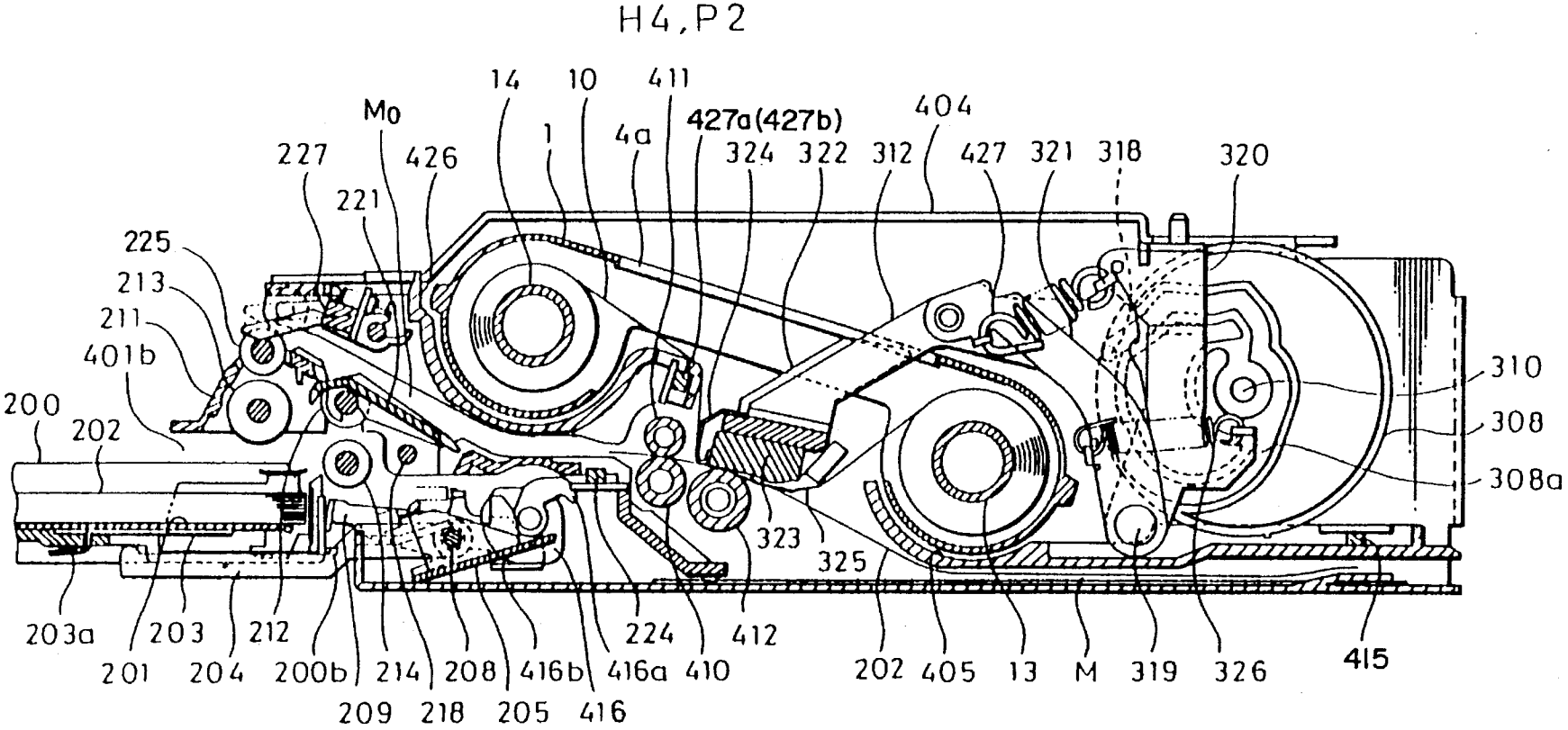
FIG. 30 is a view showing the manner in which the printer operates in a head position H4 and the sheet position P2.

Movement to head position:

The motor 300 is energized to rotate the gear 305 from the position H3 shown in FIGS. 23C, 29 to the position H4 shown in FIGS. 23D, 30 to press the head 323 against the platen 412.

Printing:

The motor 101 is energized to rotate the takeup reel base 111 to wind the ink ribbon 10. At the same time, the stepping motor 102 is reversed to reverse the capstan 410 to feed back the print sheet 202, during which time the print sheet 202 is printed by the head 323.

Figure 31:
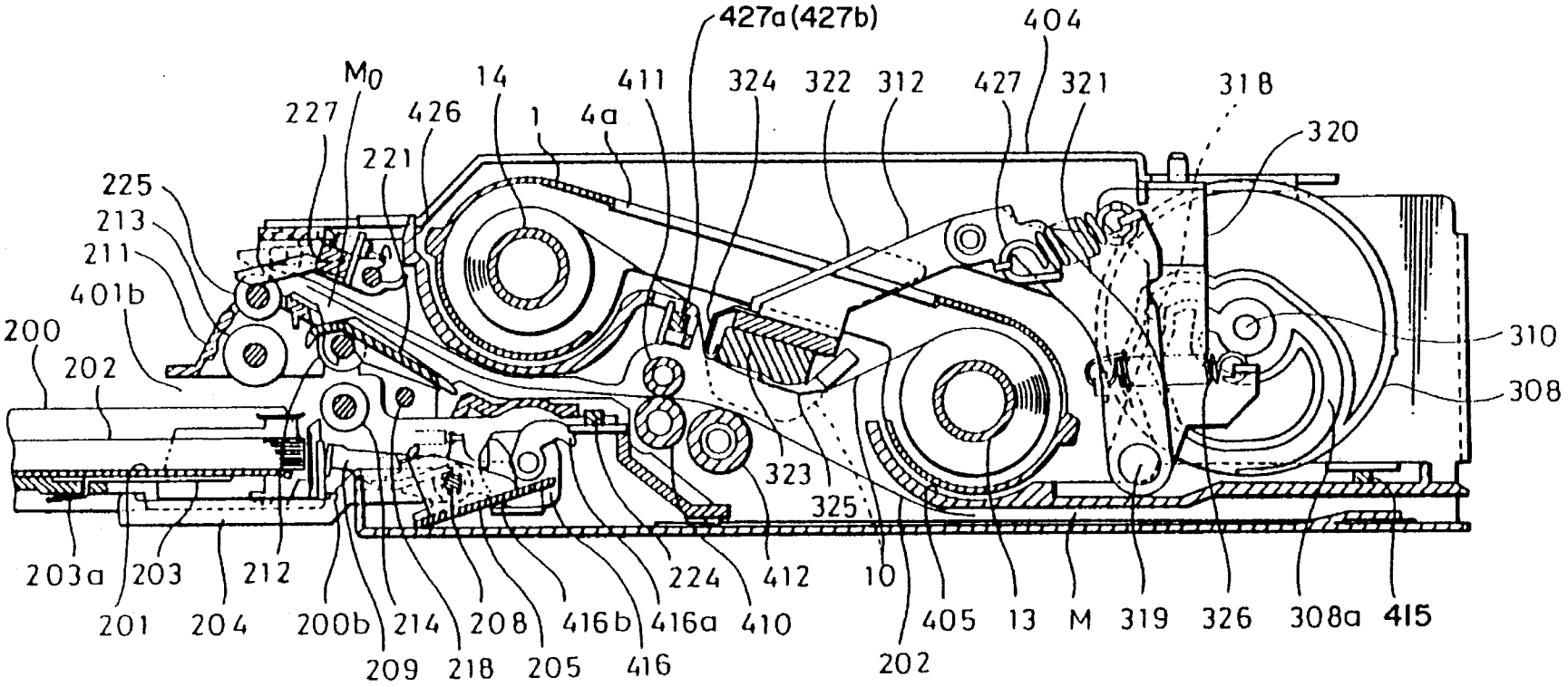
FIG. 31 is a view showing the manner in which the printer operates in the head position H2 and the sheet position P2.

Movement to head position and removal of slack from ink ribbon:

The motor 300 is energized the rotate the gear 305 from the position H4 shown in FIGS. 23D, 30 to the position H2 shown in FIGS. 23B, 31. The motor 101 is reversed for a preset period of time to cause the pinion 121 and the double gear 122 to rotate the gear pulley 123 clockwise (see FIG. 24B), whereupon the pendulum gear 124 swings clockwise into mesh with the gear 145 of the supply reel base 146. At this time, since the pin **142*a* on the change arm 142 is positioned in the cam groove 308*b* of the cam 308 in the position H1 shown in FIG. 17, the lock finger 143 and the brake finger 144 coupled to the change arm 142 are released from the gear 145 and the gear 146*a*, respectively, thus freeing the supply reel base 146. Therefore, the supply reel base 146 can be rotated in a ribbon rewinding direction by the pendulum gear 124 to remove a slack from, i.e., tighten, the ink ribbon 10**.

Bringing ink ribbon head into operative position and movement toward head position:

For a next printing operation, the motor 101 is energized until the sensors **427*a*, 427*b* detect a patch mark 12 on the ink ribbon 10, thus rotating the takeup reel base 111 in a ribbon winding direction to bring the head of the ink ribbon 10 into an operative position. The motor 101 is continuously energized for a preset period of time. If a patch mark 12 is not detected even when the motor 101** is continuously energized for the preset period of time, then it is determined that no remaining length of ink ribbon is available or a ribbon breakage occurs, and a warning is issued.

Dropping of print sheet and movement to head position:

As with the previous dropping of the print sheet 202, when the print sheet 202 is fed for a predetermined interval from the reference position in which the leading end of the print sheet 202 is detected by the sheet feed sensor 224, the leading end of the print sheet 202 is positioned beneath the head cover 325. While the leading end of the print sheet 202 is being positioned beneath the head cover 325, the motor 300 is energized to rotate the gear 305 from the position H2 shown in FIGS. 23B, 28 to the position H3 shown in FIGS. 23C, 29. The leading end of the print sheet 202 is now dropped into the passage M.

If a colored image is to be printed on the print sheet 202, then since three primary color images are printed on the print sheet 202 and the printed surface thereof is finally coated, the above printing operation is repeated four times.

Movement to head position and removal of slack from ink ribbon:

The motor 300 is energized the rotate the gear 305 from the position H4 shown in FIGS. 23D, 30 to the position H2 shown in FIGS. 23B, 31. As with the above ribbon slack removal operation, the motor 101 is reversed for a preset period of time to cause the pendulum gear 124 to mesh with the gear 145 of the supply reel base 146. The supply reel base 146 can be rotated in the ribbon rewinding direction by the pendulum gear 124 to remove a slack from the ink ribbon 10.

Discharge of printed print sheet:

After the print sheet 202 has been printed, the stepping motor 102 is reversed to rotate the capstan 410, and the motor 101 is reversed to rotate the sheet discharge roller 225 for thereby discharging the print sheet 202 through a sheet discharge passage $M_0$ out of the print sheet discharge slot 703 (see FIG. 1). If a sheet discharge sensor 227 detects the presence of a print sheet after the print sheet 202 has been discharged for a predetermined interval, then it is determined that the printer undergoes a sheet discharge failure, and a warning is issued.

Figure 32:
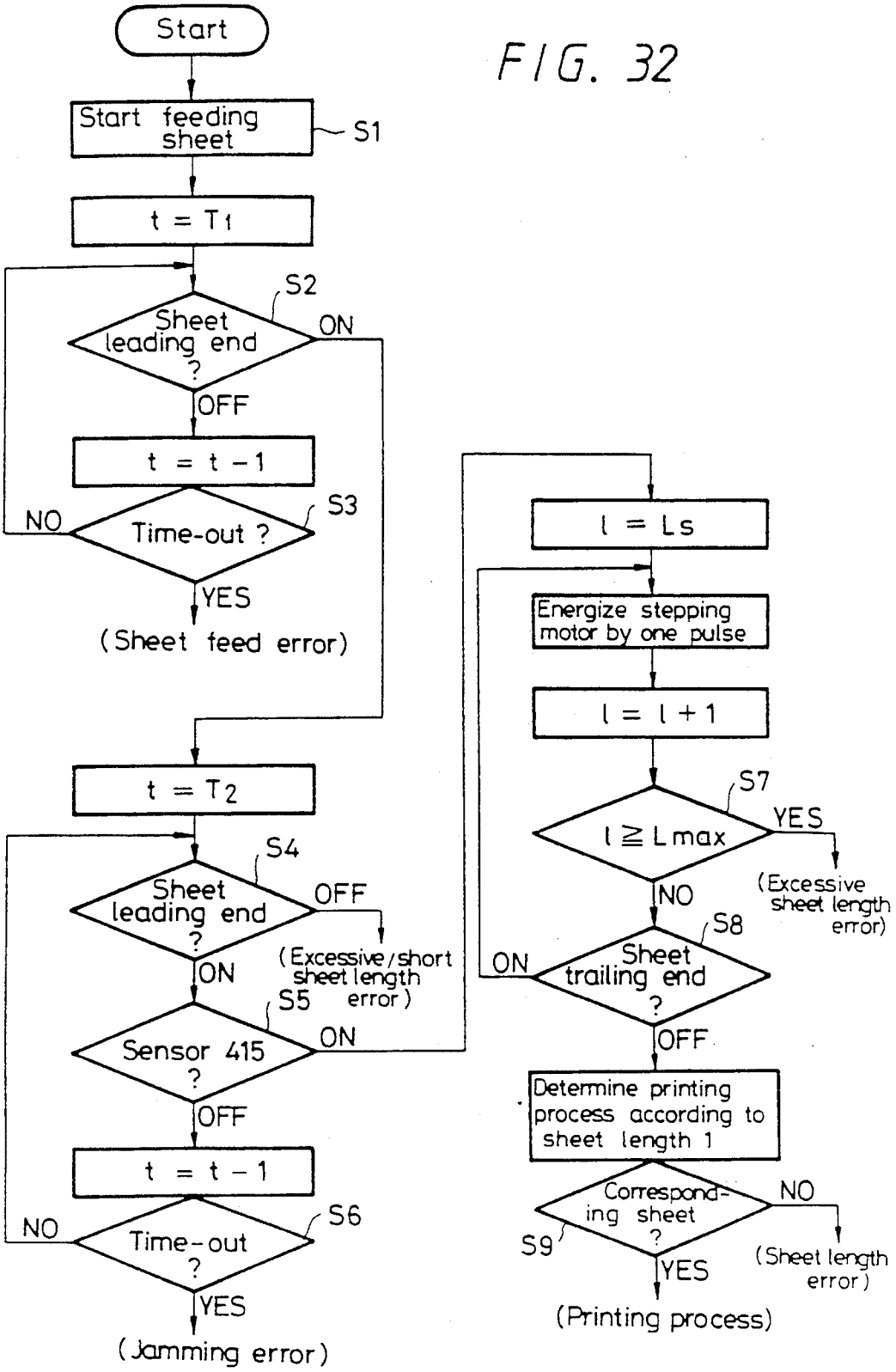
FIG. 32 is a flowchart of a process sequence for determining the length of a print sheet.

A process for identifying the length of a print sheet with the sheet feed sensor 224 and the sensor 415 will be described in greater detail below with reference to FIG. 32.

A print sheet 202 starts being fed in a step S1. The number of steps of the stepping motor 102 is determined in advance so as to correspond to the distance Ls (128 mm) from the sheet feed sensor 224 to the sensor 415. A preset period of time until the leading end of the print sheet is detected by the sheet feed sensor 224 is measured repeatedly in steps S2, S3. If no leading end of print sheet is detected by the sheet feed sensor 224 upon elapse of the preset period of time, then such a condition is judged as a sheet feed error.

If the leading end of the print sheet 202 is detected in the preset period of time by the sheet feed sensor 224 in the step S2, then the print sheet 202 is fed by the capstan 410 and the pinch roller 411, and hence the leading end of the print sheet 202 proceeds for detection by the sensor 415.

The period of time which is to be consumed until the leading end of a print sheet can be detected by the sensor 415 is determined in advance. The predetermined period of time until the leading end of the print sheet is detected by the sensor 415 is measured repeatedly in steps S4 through S6.

If the sheet feed sensor 224 is turned off by passage of the trailing end of the print sheet 202 by the sheet feed sensor 224 within the predetermined period of time in the step S4, then the print sheet 202 is judged as being shorter than a standard sheet length, and the printer operation is turned off. If the leading end of the print sheet 202 is not detected by the sensor 415 upon elapse of the predetermined period of time in the step S6, the print sheet 202 is determined as being jammed in the printer, and the printer is shut off.

Only if the leading end of the print sheet 202 is detected by the sensor 415 within the predetermined period of time in the step S5, control proceeds to following steps for detecting whether the print sheet 202 is a standard sheet 1 (L).

As described above, the distance Ls between the sheet feed sensor 224 and the sensor 415 is set to 128 mm. From the time when the leading end of the print sheet 202 is detected by the sensor 415, the print sheet 202 is fed further by the stepping motor 102 which is energized pulse by pulse until the trailing end of the print sheet 202 is detected by the sheet feed sensor 224 in steps S7, S8. The true length of the print sheet 202 can thus be calculated by adding, to 128 mm, the length that has been fed until the trailing end of the print sheet 202 is detected by the sheet feed sensor 224. If the length of the print sheet 202 exceeds the maximum standard sheet length of the standard sheet 1, then the print sheet 202 is determined as having an excessive length, and is ejected out of the printer.

A printing process to be carried out by the printer is determined depending on the length of a print sheet that has been determined as being a standard sheet. In a step S9, the printer determines whether there is a print sheet having such a sheet length. If there is no such a print sheet, then the print sheet is discharged as suffering a sheet length error. If there is such a print sheet, it is printed.

Figure 33:
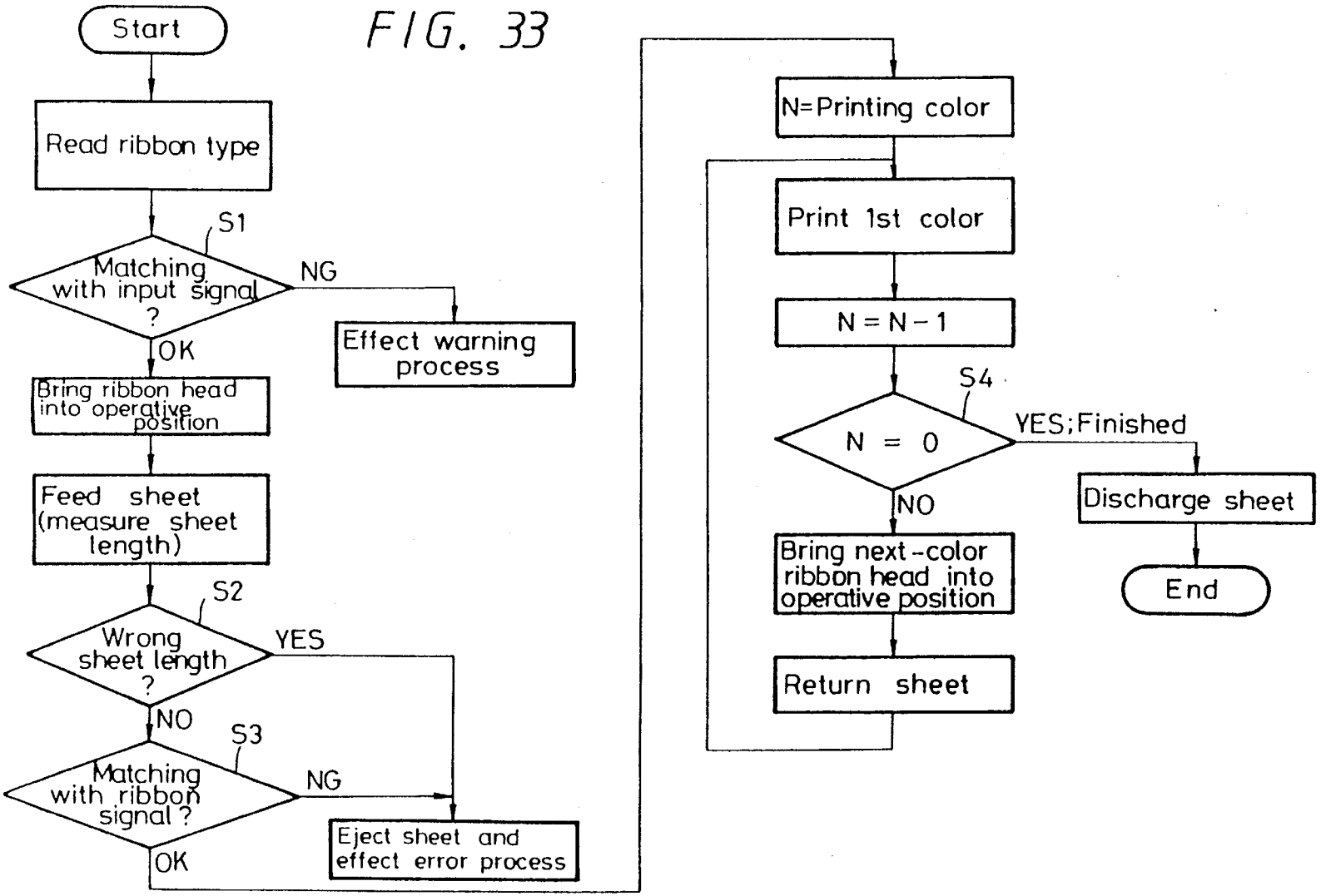
FIG. 33 is a flowchart of a process sequence for determining the matching between the type of an ink ribbon and the length of a print sheet.

A process for determining a printing process depending on the length of a print sheet 202 and the type of an ink ribbon will be described in greater detail with reference to FIG. 33.

The type of the ink ribbon in the ribbon cassette is read by the sensor 335. Then, a step S1 determines whether the type of the ink ribbon is normal or wide based on the matching with an input signal. If the type of the ink ribbon does not correspond to the printer, then a warning is issued as indicating a mismatch.

If the type of the ink ribbon is matched, then the head of the ink ribbon is brought into an operative position.

A print sheet 202 is fed into the printer, and the length of the print sheet 202 is identified. If the length of the print sheet 202 is other than the standard sheet length in a step S2, then the print sheet 202 is ejected from the printer. If the length of the print sheet 202 is equal to or shorter than the standard sheet length, then a step S3 determines whether the print sheet 202 matches the ink ribbon. If a mismatch occurs between the print sheet 202 and the ink ribbon, the print sheet 202 is ejected as suffering an error.

If the print sheet 202 and the ink ribbon are matched, then the printer initiates a printing process.

In a color printer, three printing operations are carried out on a print sheet by repeating the printing of images in three colors. Specifically, after the print sheet is printed in one color, the head of an ink ribbon of the next color is brought into an operative position, and the print sheet is fed back. Such a printing operation is repeated for each of the three colors. The printing operations are counted in a step S4. When the completion of the printing of images in three colors is detected, the print sheet is discharged, and the printing process comes to an end.

In the printer according to the present invention, as described above, since the length of a print sheet is identified, and the printing process is changed depending on the length of the print sheet. Therefore, when a print sheet other than a standard print sheet is inserted into the printer, the printer effects no printing process, and the inserted print sheet is ejected. Consequently, even if a print sheet other than a standard print sheet is inserted into the printer, no sheet jam occurs in the printer.

Upon insertion of an elongate print sheet having a size ratio of 16:9 or a panoramic ratio is inserted, the printing process can be changed as the length of the print sheet can be recognized.

Inasmuch as the length of the print sheet is determined with the two sensors, the length of the print sheet can be determined highly accurately.

The printer according to the present invention determines the matching between the type of an ink ribbon and the length of a print sheet for determining a printing process and a printing condition. Consequently, a combination of a print sheet and an ink ribbon which are possibly responsible for causing the trouble of a mismatch can be ejected.

When a combination of a highly sensitive ink ribbon and a highly sensitive print sheet is employed, the printer can automatically switch to a high-speed printing process.

A desired image can be printed in an elongate panoramic print mode when a combination of an elongate ribbon and an elongate print sheet is employed.

As described above, the printer according to the present invention has a detector for detecting the distance over which a print sheet is fed and a means for detecting whether there is a print sheet or not with at least one sensor. Since the length of a print sheet is detected when the print sheet is fed, and any print sheet other than a standard print sheet is ejected so as not to be printed, a sheet jam is prevented from occurring in the printer, and hence from interfering with a next printing process. The printer is therefore highly reliable in operation.

Furthermore, the printer according to the present invention has a ribbon identification sensor for identifying the type of an ink ribbon and a sheet length identification sensor for identifying the length of a print sheet. The matching between the type of a ribbon as identified by the ribbon identification sensor and the length of a print sheet as identified by the sheet length identification sensor is determined to determine a printing process and a printing condition. The printer effects a printing process only for a combination of a print sheet and an ink ribbon which are matched, and does not effect a printing process and ejects a print sheet for any other combinations. Therefore, undesirable printer trouble can be eliminated.

Having described a preferred embodiment of the invention with reference to the accompanying drawings, it is to be understood that the invention is not limited to that precise embodiment and that various changes and modifications could be effected by one skilled in the art without departing from the spirit or scope of the invention as defined in the appended claims.

What is claimed is:

1. A printer comprising:

a roller for feeding a print sheet into a printer mechanism;

a first sensor for detecting a leading edge and a trailing edge of the print sheet fed into the printer mechanism, said first sensor being disposed at an upstream end of a print sheet feed path along which the print sheet is guided in said printer mechanism;

a second sensor disposed proximate a downstream end of said print sheet feed path, said first sensor and said second sensor being spaced from each other along said print sheet feed path by a predetermined distance which is shorter than a predetermined print sheet length;

feed distance detector means responsive to said first and second sensors for detecting the amount of printer feed operation which occurs following a detection of a leading edge of said print sheet by said second sensor and a subsequent detection of a trailing edge of said print sheet by said first sensor;

sheet length detector means responsive to said feed distance detector means for, based on the amount of printer feed operation detected by said feed distance detector means, calculating the length of the print sheet which is fed into said printer mechanism by adding the amount of printer feed operation to said predetermined distance, and for determining if the detected length is less than a predetermined print sheet length; and a controller, responsive to said print sheet length detector for ejecting the print sheet when the calculated length of the print sheet is less than the predetermined print sheet length.

2. A printer according to claim 1, wherein said controller comprises means for detecting a sheet jam based on an output of said second sensor and said feed distance detector means when a print sheet is detected by said first sensor as having been fed the printer mechanism fails to be detected by said second sensor after a predetermined amount of printer feed operation.

3. A printer according to claim 2, wherein said controller comprises means for changing printer operating conditions and printing processes with respect to print sheets which are detected as having different lengths shorter than the predetermined sheet length, based on the signals produced by said first sensor and said second sensor.

4. A printer for printing a print sheet with an ink ribbon, said ribbon being contained in a single ribbon cassette which has a rotatable portion on which a colored pattern is formed, comprising:

ribbon identification means including optical sensor means, for identifying the type of an ink ribbon disposed in said printer, said optical sensor means being responsive to the colored code pattern on the rotatable portion of said ribbon cassette;

sheet length measuring means for measuring a length of the print sheet actually fed into said printer; and a controller for determining a printing process and a printing condition based on a matching between the type of ink ribbon identified by said ribbon identification means and the length of the print sheet measured by said sheet length measuring means.

5. A printer according to claim 4, wherein said controller comprises means for ejecting a print sheet without printing the print sheet or preventing printing on the print sheet if there is a mismatch between the type of an ink ribbon identified by said ribbon identification means and the length of the print sheet measured by said sheet length measuring means.

6. A printer comprising:

a paper tray in which sheets of printing paper are stored;

roller means for extracting a print sheet from said paper tray and feeding it into the printer mechanism, said printer mechanism including a print sheet feed path along which each sheet of print paper inducted into the printer mechanism is moved;

print sheet drive means for selectively driving a print sheet in first and second directions along said print sheet path;

a printer head which can be moved by print head support means toward and away from a printing position;

a first sheet sensor disposed at an upstream end of the print sheet feed path at a location upstream of the printing position of said print head;

a second sensor disposed at a downstream end of the print sheet feed path at a predetermined distance from said first sensor; and control means responsive to said first and second sensors and said print sheet drive means, said control means including:

means for detecting the passage of a leading edge of a print sheet past said first sensor and for maintaining the operation of said print sheet drive means to move said print sheet in the first direction until the leading edge is detected by said second sensor, said control means then measuring the amount of print sheet drive means operation until the trailing edge of the print sheet is detected by said first sensor, means for calculating the length of the print sheet based on the sum of the predetermined distance and the length indicated by the amount of print sheet drive means operation between the detection of the leading edge of the print sheet by said second sensor and the detection of the trailing edge of said print sheet by said first sensor; and means for operating said print sheet drive means to eject the print sheet in the event that the calculated length of the print sheet does not meet predetermined length requirements.

7. A printer according to claim 6, wherein said printer further comprises:

a print ribbon cassette having a rotatable spool, said spool being formed with a colored pattern indicative of the type of ribbon contained in said print ribbon cassette;

optical sensor means for detecting the colored pattern and for issuing a signal indicative of the type of ribbon contained in said print ribbon cassette; and wherein said control means further includes:

means responsive to the signal indicative of the type of ribbon contained in said print ribbon cassette and the calculated length of the print sheet, means for preventing printing on said print sheet by said print head in the event that predetermined print sheet length and ribbon type requirements are not met.

8. A printer according to claim 6, wherein said control means further includes means for issuing a paper jam alarm in the event that more than a predetermined amount of print sheet drive means operation occurs following the detection of a leading edge of a print sheet by said first sensor without the detection of the leading edge by said second sensor.

* * * * *